US007079122B2

(12) United States Patent
Morita

(10) Patent No.: US 7,079,122 B2
(45) Date of Patent: Jul. 18, 2006

(54) SCAN-DRIVING CIRCUIT, DISPLAY DEVICE, ELECTRO-OPTICAL DEVICE, AND DRIVING METHOD OF THE SCAN-DRIVING CIRCUIT

(75) Inventor: Akira Morita, Suwa (JP)

(73) Assignee: Seiko Epson Corporation (JP)

( * ) Notice: Subject to any disclaimer, the term of this patent is extended or adjusted under 35 U.S.C. 154(b) by 440 days.

(21) Appl. No.: 10/155,889

(22) Filed: May 23, 2002

(65) Prior Publication Data

US 2002/0190944 A1 Dec. 19, 2002

(30) Foreign Application Priority Data

May 24, 2001 (JP) ..... 2001-155195

(51) Int. Cl.
*G09G 3/36* (2006.01)

(52) U.S. Cl. ..... 345/204; 345/87; 345/95; 345/97; 345/99; 345/100; 345/211; 345/212; 345/214; 348/790; 348/792; 349/33

(58) Field of Classification Search ..... 345/87, 345/95, 97, 99, 100, 204, 211, 212, 214; 348/790, 792; 349/33
See application file for complete search history.

(56) References Cited

U.S. PATENT DOCUMENTS

| | | | | |
|---|---|---|---|---|
| 5,745,092 A | * | 4/1998 | Ito | 345/95 |
| 5,745,156 A | * | 4/1998 | Federico et al. | 347/256 |
| 5,815,128 A | * | 9/1998 | Hoshino et al. | 345/89 |
| 5,952,990 A | * | 9/1999 | Inoue et al. | 345/97 |
| 6,046,790 A | * | 4/2000 | Hara et al. | 349/172 |
| 6,522,319 B1 | | 2/2003 | Yamazaki | |

FOREIGN PATENT DOCUMENTS

| | | |
|---|---|---|
| CN | 1262761 A | 8/2000 |
| JP | 63-63094 | 3/1988 |
| JP | 04-165329 | 6/1992 |
| JP | 07-036406 | 2/1995 |
| JP | 09-055909 | 2/1997 |
| JP | 2000-181414 | 6/2000 |
| JP | 2001-083941 | 3/2001 |
| JP | 2001-109439 | 4/2001 |
| JP | 2001-242818 | 9/2001 |
| JP | 2001-343928 | 12/2001 |
| JP | 2002-204297 | 7/2002 |
| JP | 2002-268609 | 9/2002 |

OTHER PUBLICATIONS

Communication from Chinese Patent Office re: counterpart application.

Communication from Japan Patent Office re: related application.

* cited by examiner

*Primary Examiner*—Amir A. Awad
*Assistant Examiner*—Vincent E. Kovalick
(74) *Attorney, Agent, or Firm*—Harness, Dickey & Pierce, P.L.C.

(57) ABSTRACT

A scan-driving circuit for making a high image quality and a low power consumption compatible. This scan-driving circuit comprises: a shift register including first to Nth flip-flops corresponding to first to Nth scan lines, respectively, and connected in series; a level conversion section including first to Nth level shifter circuits for shifting the voltage levels of the individual output nodes of the first to Nth flip-flops individually; and a scan line drive section including first to Nth drive circuits for driving the first to Nth scan lines sequentially in a manner to correspond to the potentials of the output nodes of the first to Nth level shifter circuits. The first to Nth scan lines are divided into a plurality of blocks, for which the scan lines are individually arranged. The first to Nth drive circuits scan and drive the scan lines in the designated block at a time of a partial display in which the display and drive are done on a block basis.

13 Claims, 17 Drawing Sheets

SCAN-DRIVING CIRCUIT, DISPLAY DEVICE, ELECTRO-OPTICAL DEVICE, AND DRIVING METHOD OF THE SCAN-DRIVING CIRCUIT

Japanese Patent Application No. 2001-155195, filed on May 24, 2001, is hereby incorporated by reference in its entirety.

TECHNICAL FIELD

The present invention relates to a scan-driving circuit, and a display device, an electro-optical device and a scanning driving method using the circuit.

BACKGROUND

In a display section of an electronic device such as a mobile telephone, there is used a liquid crystal panel for lowering the power consumption and for reducing the size and weight of the electronic device. For this liquid crystal panel, there has been demanded a higher image quality, as a high-information still or moving image is distributed according to the wide spreading of the mobile telephone in the recent years.

As this liquid crystal panel for realizing the high image quality of the display section of the electronic device, there is known the active matrix type liquid crystal panel using a thin film transistor (as will be abbreviated into the "TFT") liquid crystal. This active matrix type liquid crystal panel using the TFT liquid crystal is better suitable for realizing a high-speed response and a high contrast and for displaying moving images than the simple matrix type liquid crystal panel using the STN (Super Twisted Nematic) liquid crystal by the dynamic drive.

SUMMARY

According to one aspect of the present invention, there is provided a scan-driving circuit which drives first to Nth (N is a natural number) scan lines of an electro-optical device including a plurality of pixels which are defined by the first to Nth scan lines and first to Mth (M is a natural number) signal lines, the first to Nth scan lines and the first to Mth signal lines crossing each other, comprising:

a shift register which includes first to Nth flip-flops corresponding to the first to Nth scan lines, respectively, and connected in series, and sequentially shifts a given pulse signal;

a level conversion section including first to Nth level shifter circuits which shift the voltage levels of the output nodes of the first to Nth flip-flops and output signals of the shifted voltage levels; and a scan line drive section including first to Nth drive circuits which sequentially drive the first to Nth scan lines corresponding to logic levels of output nodes of the first to Nth level shifter circuits, wherein the first to Nth scan lines are divided into a plurality of blocks, each block constituting a plurality of scan lines, and wherein the first to Nth drive circuits drive the plurality of scan lines in a designated block at a time of a partial display in which scan-driving is performed on a block basis.

According to another aspect of the present invention, there is provided a display device comprising:

an electro-optical device including a plurality of pixels which are defined by first to Nth (N is a natural number) scan lines and a plurality of signal lines, the first to Nth scan lines and the signal lines crossing each other:

the above-described scan-driving circuit which drives the first to Nth scan lines; and a signal drive circuit which drives the signal lines based on image data.

According to still another aspect of the present invention, there is provided an electro-optical device comprising: a plurality of pixels defined by first to Nth (N is a natural number) scan lines and a plurality of signal lines, the first to Nth scan lines and the signal lines crossing each other:

the above-described scan-driving circuit which drives the first to Nth scan lines; and a signal drive circuit which drives the signal lines based on image data.

According to a further aspect of the present invention, there is provided a method of driving a scan-driving circuit which drives first to Nth (N is a natural number) scan lines in an electro-optical device including a plurality of pixels which are defined by the first to Nth scan lines and first to Mth (M is a natural number) signal lines, the first to Nth scan lines and the first to Mth signal lines crossing each other, the method comprising:

setting a mode to a partial display mode for partially displaying an area on a block basis, in which the first to Nth scan lines are divided into a plurality of blocks, each block constituting a plurality of scan lines; and driving the plurality of scan lines sequentially in a designated block at the time of the partial display mode.

DETAILED DESCRIPTION

Figure 1:
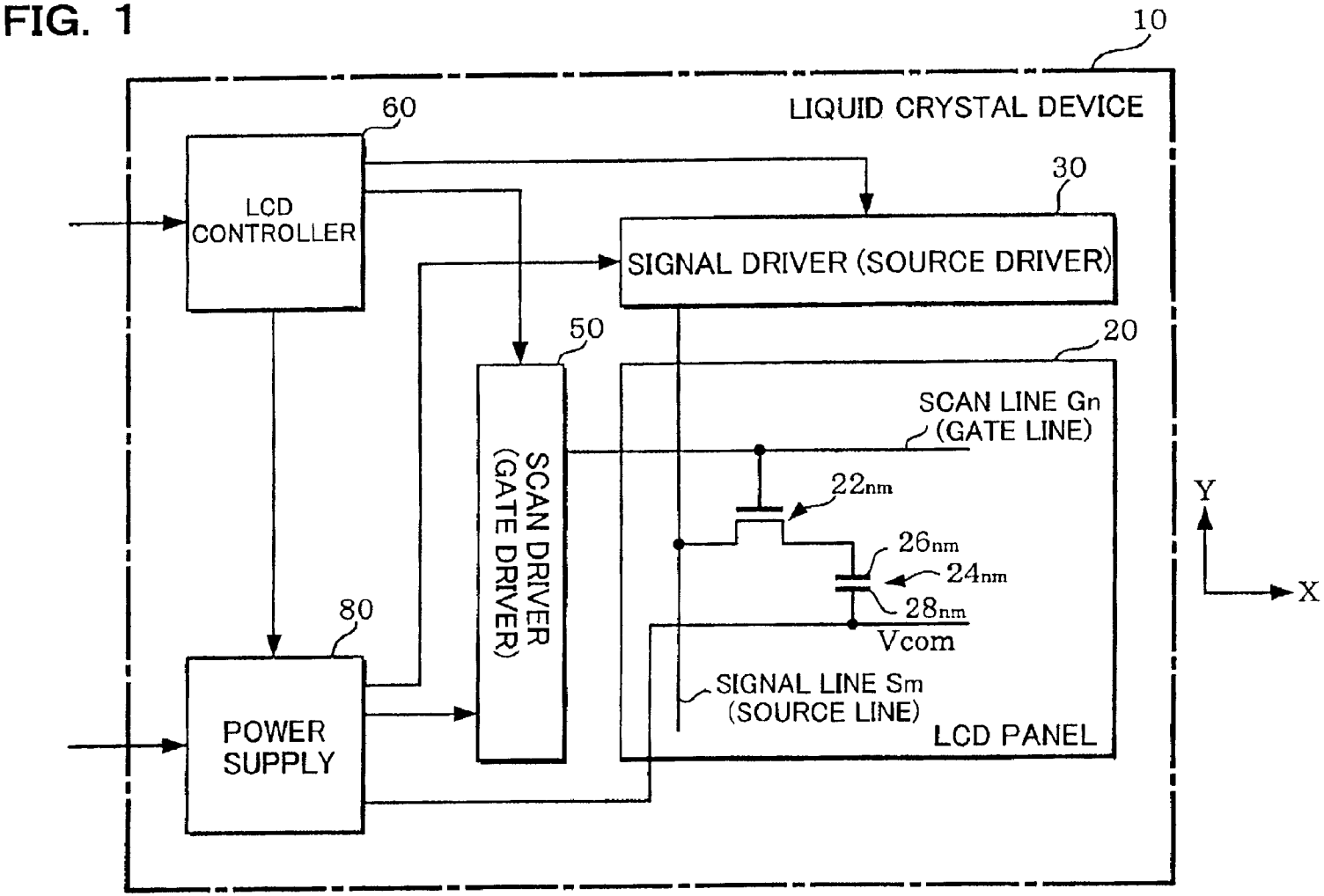
FIG. 1 is a block diagram schematically showing a construction of a display device, to which a scan-driving circuit (or a scan driver) according to an embodiment of the invention is applied.

The present invention will be described in connection with its embodiment.

Here, the embodiment to be described should not limit the contents of the invention, as defined in the scope of Claims, in the least. Moreover, all the constructions to be described in the following embodiment are not essential for the components of the construction of the invention.

Here, it has been difficult to adopt an active matrix type liquid crystal panel using the TFT liquid crystal as the display section of a battery-driven mobile type electronic device such as a mobile telephone having a high power consumption.

The following embodiment can make a high image quality and a low power consumption compatible to provide a scan-driving circuit suitable for the active matrix type liquid crystal panel, and a display device, an electro-optical device and a scan-driving method using the signal drive circuit.

According to an embodiment of the present invention, there is provided a scan-driving circuit which drives first to Nth (N is a natural number) scan lines of an electro-optical device including a plurality of pixels which are defined by the first to Nth scan lines and first to Mth (M is a natural number) signal lines, the first to Nth scan lines and the first to Mth signal lines crossing each other, comprising:

a shift register which includes first to Nth flip-flops corresponding to the first to Nth scan lines, respectively, and connected in series, and sequentially shifts a given pulse signal;

a level conversion section including first to Nth level shifter circuits which shift the voltage levels of the output nodes of the first to Nth flip-flops and output signals of the shifted voltage levels; and a scan line drive section including first to Nth drive circuits which sequentially drive the first to Nth scan lines corresponding to logic levels of output nodes of the first to Nth level shifter circuits, wherein the first to Nth scan lines are divided into a plurality of blocks, each block constituting a plurality of scan lines, and wherein the first to Nth drive circuits drive the plurality of scan lines in a designated block at a time of a partial display in which scan-driving is performed on a block basis.

Here, the electro-optical device may be constructed to include: first to Nth scan lines and first to Mth signal lines crossing each other; N×M switching sections connected to the first to Nth scan lines and the first to Mth signal lines; and N×M pixel electrodes connected to the switching sections, for example.

Moreover, the scan lines to be divided into blocks may be either adjacent scan lines or arbitrarily selected scan lines.

According to this embodiment, the scan-driving circuit which drives the scan lines of the electro-optical device is provided with the scan line drive section including the first to Nth drive circuits which drives the scan lines selected on a block basis in which a given number of scan lines are included. It is, therefore, possible to easily control the partial display which consists of a display area to be scan-driven on a block basis and a non-display area not to be scan-driven on a block basis. As a result, it is possible to reduce the power consumption accompanied by the scan-driving of the non-display area. Moreover, the power consumption can be effectively reduced independently of an inverted drive method such as the line inverted drive method or the frame inverted drive method.

In this embodiment, moreover, the scan-driving circuit may further comprise:

an input terminal which inputs output enable signals synchronized with scanning timings of the scan lines in a block in which the plurality of scan lines are driven; and first to Nth mask circuits which mask the logic levels of the output nodes of the first to Nth level shifter circuits based on the output enable signals.

Here, the first to Nth mask circuits which mask a logic level set the output nodes of the corresponding first to Nth level shifter circuits in a fixed state (e.g., the logic level "L") independently of the logic levels of the output nodes of the corresponding first to Nth level shifter circuits but according to the state of the output enable signals. Moreover, the masked signal is supplied to the scan line drive section including the first to Nth drive circuits which drives the first to Nth scan lines sequentially.

In this embodiment, the first to Nth drive circuits which sequentially drive the first to Nth scan lines select the individual scan lines, respectively. Therefore, given scan lines can be kept from being driven without changing the scanning driving timings of the scan lines by supplying the output enable signals through the input terminal in accordance with the individual scanning timings. By masking the logic levels of the output nodes of the level shifter circuits with the output enable signals in accordance with the driving timings of the scan lines of the non-display area, the partial display can be easily controlled. As a result, it is possible to reduce the electric power consumption for driving the scan lines of the non-display area.

In this embodiment, moreover, the scan-driving circuit may further comprise:

a block select data holding section which holds block select data to designate a block in which the plurality of scan lines are driven, wherein the first to Nth drive circuits drive the plurality of scan lines in the block designated by the block select data.

Thus, the block select data holding section is further comprised so that the block select data holding section can hold the block select data indicating on a block basis whether or not the scan lines of the individual blocks are to be driven. As a result, the first to Nth drive circuits for sequentially driving the scan lines of the block selected with the block select data can arbitrarily change the block in which the scan lines are driven, so that the dynamically controllable partial display can be easily realized.

In this embodiment, moreover, the scan-driving circuit may further comprise:

a data switching circuit which bypasses and outputs one of a shift input to be input to a front flip-flop in a Pth (P is a natural number) block of the first to Nth flip-flops which constitute the shift register and a shift output to be output from a last flip-flop in the Pth block, to a (P+1) th block based on the block select data set to select the Pth block.

Thus, the data switching circuit is further comprised to bypass the shift input to the flip-flops corresponding to the scan lines of the block designated with the block select data, to the flip-flops corresponding to the scan lines of the adjacent block. Since only the scan lines of the block set for the display area may be driven, it is possible to reduce the electric power consumption for the time period for driving the scan lines of the non-display area in a given vertical scanning period.

In this embodiment, moreover, the electro-optical device may includes pixel electrodes which correspond to the pixels and may be disposed through switching sections connected to the first to Nth scan lines and the first to Mth signal lines, and polarity of applied voltage to electro-optical elements corresponding to the pixel electrodes may be reversed in each frame, and the scan line drive section may sequentially drive all the scan lines at an interval of given odd number of frames of three or more frames.

In this manner, refreshing, in which the scan lines of the block set for the non-display area are driven at an interval of given odd number of frames of three or more frames, while the scan lines of the block set for the display area are driven in each frame, is performed. Therefore, the construction can cope with the polarity inverted drive method in which the polarity of the applied voltage of the electro-optical elements corresponding to the pixels is inverted, to prevent the deterioration of the liquid crystal connected with the TFT, for example.

In this embodiment, moreover, the electro-optical device may include pixel electrodes which correspond to the pixels and may be disposed through switching sections connected to the first to Nth scan lines and the first to Mth signal lines, and the scan line drive section may sequentially drive all the scan lines every time designation of the block in which the plurality of scan lines are driven is changed at least on a block basis.

Thus, the scan lines of the block set in the display area are scanned and driven for one frame period, whereas the scan lines of the block set in the non-display area are scanned and driven for the refreshing each tome the display area is set, changed and extinguished. Therefore, the electro-optical elements corresponding to the pixels can be driven at a predetermined interval. It is, therefore, possible to eliminate the gray display of the non-display area, as might otherwise be caused by the leakage of the TFTs which are neither scanned nor driven for a constant period, for example.

In the embodiment, moreover, the block may have eight scan lines.

Then, the display area and the non-display area can be set at the unit of character letters, to simplify the partial display control thereby to provide an image by an effective partial display.

According to another embodiment of the present invention, the display device may comprise:

an electro-optical device including a plurality of pixels which are defined by first to Nth (N is a natural number) scan lines and a plurality of signal lines, the first to Nth scan lines and the signal lines crossing each other:

any one of scan-driving circuits described above which drives the first to Nth scan lines; and a signal drive circuit which drives the signal lines based on image data.

Therefore, it is possible to provide a display device for realizing a low power consumption by the partial display control. A partial display of a high image quality can also be realized by applying the active matrix type liquid crystal panel, for example.

According to still another embodiment of the present invention, there is provided an electro-optical device which comprises:

a plurality of pixels defined by first to Nth (N is a natural number) scan lines and a plurality of signal lines, the first to Nth scan lines and the signal lines crossing each other:

any one of scan-driving circuits described above which drives the first to Nth scan lines; and a signal drive circuit which drives the signal lines based on image data.

Therefore, it is possible to provide an electro-optical device for realizing a low power consumption by the partial display control. A partial display of a high image quality can also be realized by applying the active matrix type liquid crystal panel, for example.

According to a further embodiment of the present invention, there is provided a method of driving a scan-driving circuit which drives first to Nth (N is a natural number) scan lines in an electro-optical device including a plurality of pixels which are defined by the first to Nth scan lines and first to Mth (M is a natural number) signal lines, the first to Nth scan lines and the first to Mth signal lines crossing each other, the method comprising:

setting a mode to a partial display mode for partially displaying an area on a block basis, in which the first to Nth scan lines are divided into a plurality of blocks, each block constituting a plurality of scan lines; and driving the plurality of scan lines sequentially in a designated block at the time of the partial display mode.

According to this method, the partial display can be controlled on a block basis to simplify the control circuit and to reduce the power consumption. A partial display of a high image quality can also be realized by applying the active matrix type liquid crystal panel, for example.

Here, the method may further comprise: driving all the scan lines sequentially for every predetermined frames at the time of the partial display mode. When polarity of applied voltage to the pixels is reversed in each frame, all the scan lines may be sequentially driven at an interval of odd frames of three or more frames. Alternatively, all the scan lines may be sequentially driven every time designation of the block to be set for partial display is changed. In either case, after driving of the plurality of scan lines in the designated block has ended in one frame, driving of all the scan lines may be interrupted for the residual period of the frame. Therefore, it is possible to reduce the power consumption. A preferred embodiment of the present invention will be described in detail with reference to the accompanying drawings.

1. Display Device 1.1 Construction of Display Device

FIG. 1 shows a schematic construction of a display device, to which a signal drive circuit (or a signal driver) of this embodiment is applied.

A liquid crystal device 10 as a display device includes: a liquid crystal display (as will be abbreviated into the "LCD") panel 20; a signal driver (or a signal driving circuit) (or a source driver in a narrow sense) 30, a scan driver (or a scan-driving circuit (or a gate driver in a narrow sense) 50, and an LCD controller 60 and a power circuit 80.

The LCD panel (or an electro-optical device in a broad sense) 20 is formed over a glass substrate, for example. Over this glass substrate, there are arranged: a plurality of scan lines (or gate lines in a narrow sense) $G_1$ to $G_N$ (where N indicates a natural number of 2 or more) arrayed in a Y-direction and extending individually in an X-direction; and a plurality of signal lines (or source lines in a narrow sense) $S_1$ to $S_M$ (where M indicates a natural number of 2 or more) arrayed in the X-direction and extending individually in the Y-direction. At the cross point between the scan line $G_n$ ($1 \leqq n \leqq N$, n indicates a natural number) and the signal line $S_m$ ($1 \leqq m \leqq M$, m indicates a natural number), moreover, there is disposed a TFT 22*nm* (or a switching section in a broad sense).

The gate electrode of the TFT $\mathbf{22}_{nm}$ is connected with the scan line $G_n$. The source electrode of the TFT $\mathbf{22}_{nm}$ is connected with the signal line $S_m$. The drain electrode of the TFT $\mathbf{22}_{nm}$ is connected with a pixel electrode $\mathbf{26}_{nm}$ of a liquid crystal capacitor (or a liquid crystal element in a broad sense) $\mathbf{24}_{nm}$.

In the liquid crystal capacitor $\mathbf{24}_{nm}$, a liquid crystal is sealed between the pixel electrode $\mathbf{26}_{nm}$ and a counter electrode $\mathbf{28}_{nm}$ so that the transmission factor of the pixel is changed according to the voltage applied between those electrodes.

To the counter electrode $\mathbf{28}_{nm}$, there is fed a counter electrode voltage Vcom which is generated by the power circuit 80.

The signal driver 30 is based on the image data at one horizontal scanning section, to drive the signal lines $S_1$ to $S_m$ of the LCD panel 20.

The scan driver 50 is synchronized with a horizontal synchronizing signal for one vertical scanning period, to scan and drive the scan lines $G_1$ to $G_N$ of the LCD panel 20 sequentially.

In accordance with the contents which are set by a host such as a not-shown central processing section (as will be abbreviated into the "CPU"), the LCD controller 60 controls the signal driver 30, the scan driver 50 and the power circuit 80. More specifically, the LCD controller 60 sets the action mode or feeds a vertical synchronizing signal or the horizontal synchronizing signal it produces, for the signal driver 30 and the scan driver 50, and feeds the polarity inverting timing of the counter electrode voltage Vcom to the power circuit 80.

The power circuit 80 is based on the reference voltage fed from the outside, to generate the voltage level necessary or the counter electrode voltage Vcom for driving the liquid crystal of the LCD panel 20. These various voltage levels are fed to the signal driver 30, the scan driver 50 and the LCD panel 20. Moreover, the counter electrode voltage Vcom is fed to the counter electrodes which are opposed to the pixel electrodes of the TFTs of the LCD panel 20.

The liquid crystal device 10 thus constructed is controlled by the LCD controller 60 and based on the image data fed from the outside, to drive the display of the LCD panel 20 in association with the signal driver 30, the scan driver 50 and the power circuit 80.

Here in FIG. 1, the liquid crystal device 10 is constructed to include the LCD controller 60 but may also be constructed by disposing the LCD controller 60 outside of the liquid crystal device 10. Alternatively, the liquid crystal device 10 can also be constructed to include a host together with the LCD controller 60.

Signal Driver

Figure 2:
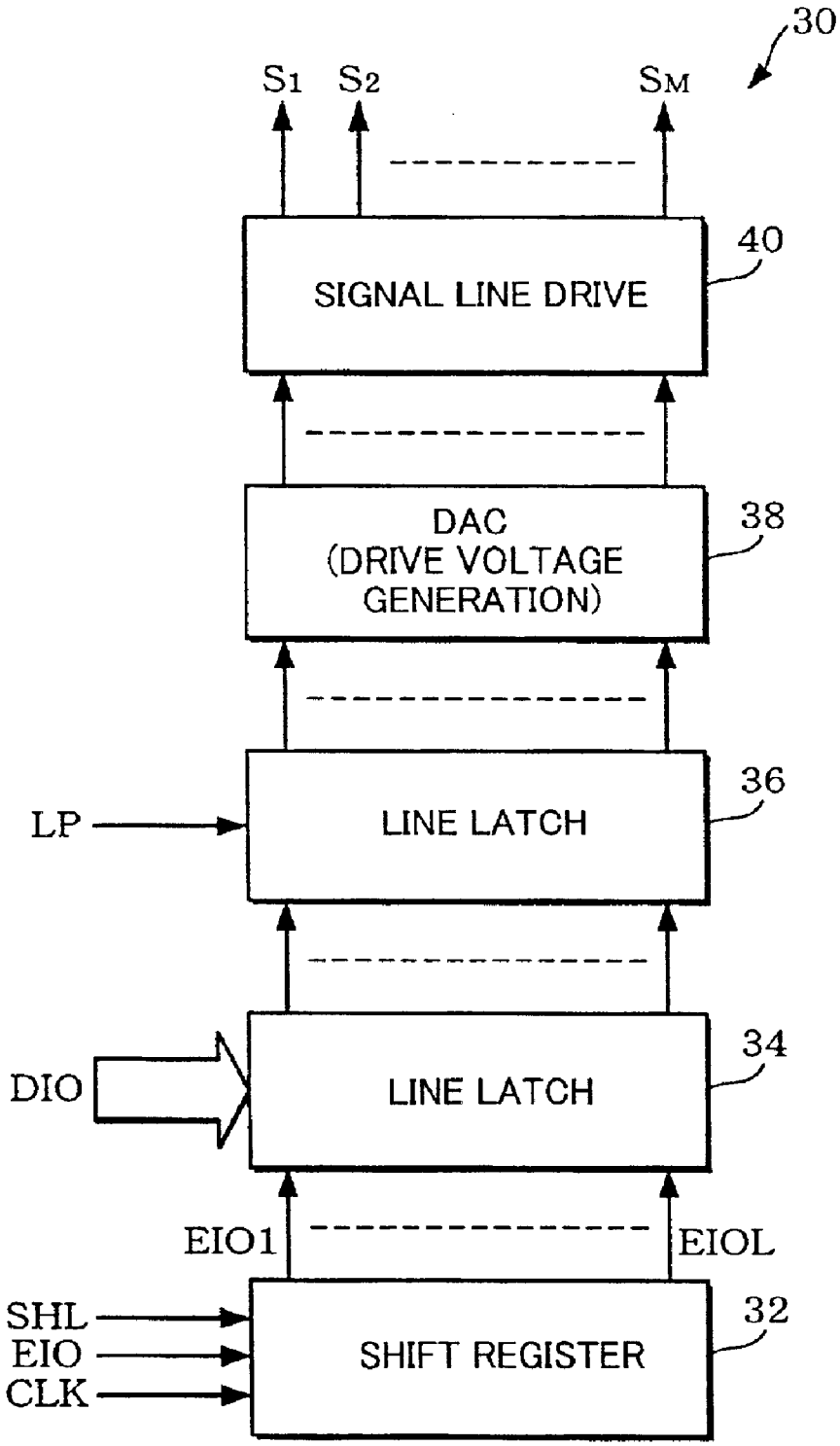
FIG. 2 is a block diagram schematically showing the construction of a signal driver shown in FIG. 1.

FIG. 2 shows a schematic construction of the signal driver shown in FIG. 1.

The signal driver 30 includes a shift register 32, line latches 34 and 36, a digital/analog converter circuit (or a drive voltage generating circuit in a broad sense) 38, and a signal line drive circuit 40.

The shift register 32 is provided with a plurality of flip-flops, which are sequentially connected. This shift register 32 shifts, when it holds an enable input/output signal EIO in synchronism with a clock signal CLK, the enable input/output signal EIO to the adjoining flip-flops sequentially in synchronism with the clock signal CLK.

Moreover, this shift register 32 is fed with a shift direction switching signal SHL. In response to the shift direction switching signal SHL, the shift register 32 is switched between the shift direction of image data (DIO) and the input/output direction of the enable input/output signal EIO. By switching the shift direction in response to the shift direction switching signal SHL, therefore, even if position of the LCD controller 60 for feeding the image data to the signal driver 30 is different according to the packaged state of the signal driver 30, a soft packaging can be made without increasing its area by designing its wiring lines.

The line latch 34 is fed with the image data (DIO) at the unit of 18 bits (i.e., 6 bits (of gradation data)×3 (of individual RGB colors)), for example, from the LCD controller 60. The line latch 34 latches the image data (DIO) in synchronism with the enable input/output signal EIO shifted sequentially by the individual flip-flops of the shift register 32.

In synchronism with a horizontal synchronizing signal LP fed from the LCD controller 60, the line latch 36 latches the image data of one horizontal scanning section, as latched by the line latch 34.

The DAC 38 generates, for each signal line, the drive voltage which was made analog on the basis of the image data.

On the basis of the drive voltage generated by the DAC 38, the signal line drive circuit 40 drives the signal lines.

This signal driver 30 fetches the image data sequentially at a predetermined unit (e.g., at the unit of 18 bits), as sequentially inputted from the LCD controller 60, and the line latch 36 latches the image data at one horizontal scanning section in synchronism with the horizontal synchronizing signal LP. On the basis of these signals, moreover, the individual signal lines are driven. As a result, the source electrodes of the TFTs of the LCD panel 20 are fed with the drive voltages based on the image data.

Scan Driver

Figure 3:
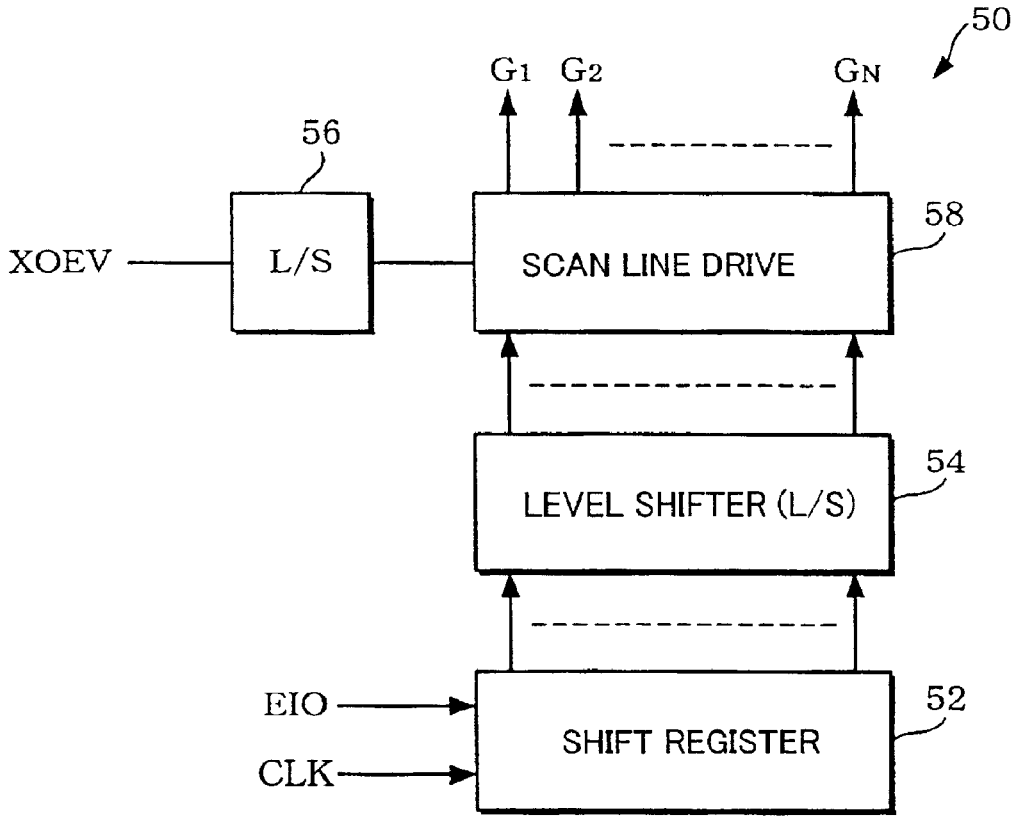
FIG. 3 is a block diagram schematically showing the construction of a scan driver shown in FIG. 1.

FIG. 3 shows a schematic construction of the scan driver shown in FIG. 1.

The scan driver 50 includes a shift register 52, level shifters (as will be abbreviated into the "L/S") 54 and 56, and a scan line drive circuit 58.

With the shift register 52, there are sequentially connected the flip-flops which are provided to correspond to the individual scan lines. When the enable input/output signal EIO is latched in the flip-flops in synchronism with the clock signal CLK, the shift register 52 shifts the enable input/ output signal EIO to the adjoining flip-flops sequentially in synchronism with the clock signal CLK. The enable input/output signal EIO thus inputted is the vertical synchronizing signal fed from the LCD controller 60.

The L/S 54 makes shift to a voltage level according to the liquid crystal material of the LCD panel 20 and the transistor capability of the TFTs. This voltage level has to be as high as 20 to 50 V, for example, so that a high breakdown process used is different from that of another logic circuit section.

The scan line drive circuit 58 makes a CMOS drive on the basis of the drive voltage shifted by the L/S 54. Moreover, this scan driver 50 has the L/S for performing the voltage shift of an output enable signal XOEV fed from the LCD controller 60. The scan line drive circuit 58 is turned ON/OFF in response to the output enable signal XOEV shifted by the L/S 56.

In this scan driver 50, the enable input/output signal EIO inputted as the vertical synchronizing signal is shifted sequentially to the individual flip-flops of the shift register 52 in synchronism with the clock signal CLK. The individual flip-flops of the shift register 52 are provided to correspond to the individual scan lines so that these scan lines are sequentially selected alternatively with the pulses of the vertical synchronizing signals latched in the individual flip-flops. The scan line selected is driven by the scan line drive circuit 58 at the at the voltage level shifted by the L/S 54. As a result, the gate electrodes of the TFTs of the LCD panel 20 are fed with the predetermined scanning drive voltage for one vertical scanning period. At this time the drain electrodes of the TFTs of the LCD panel 20 are set at substantially equal potentials corresponding to the potential of the signal lines connected with the source electrodes.

LCD Controller

Figure 4:
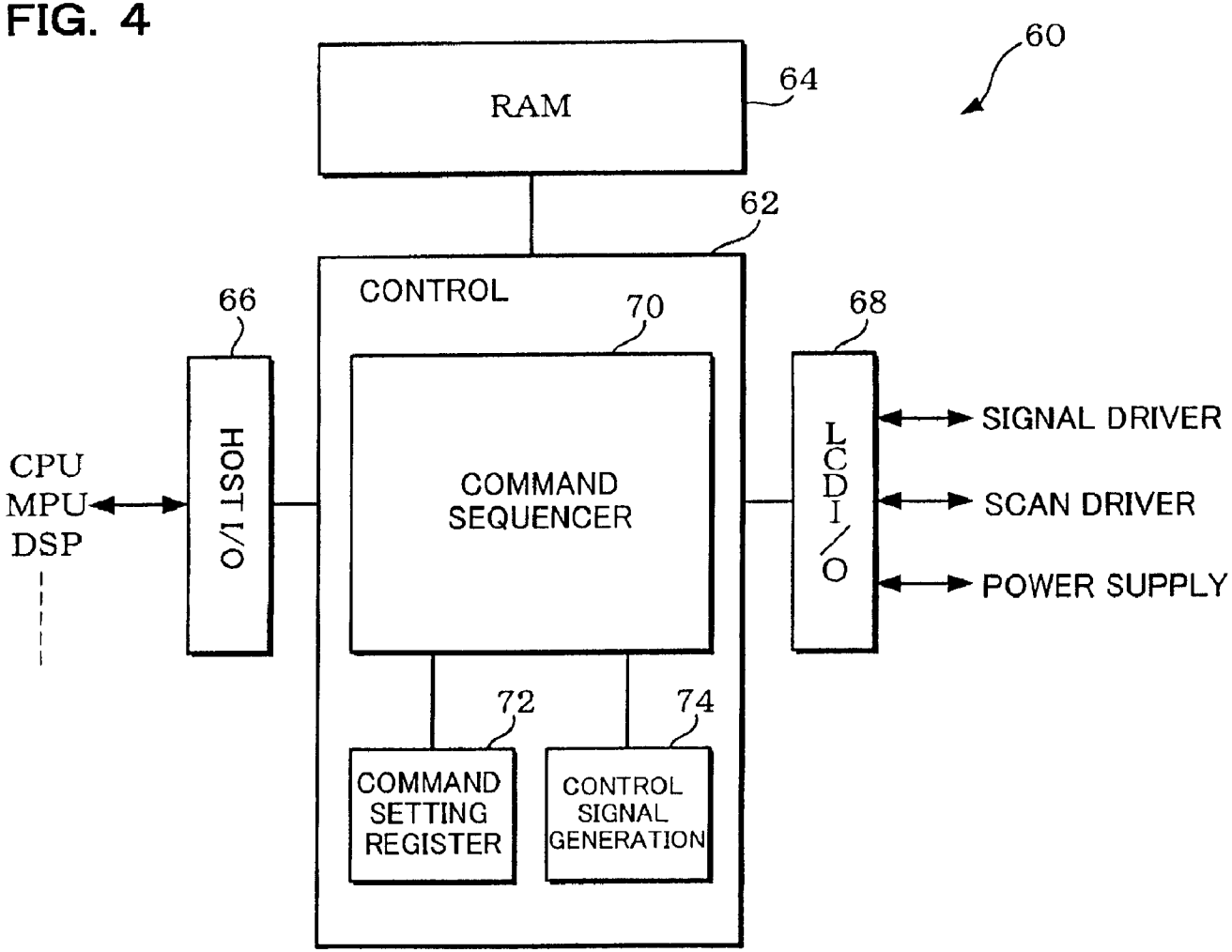
FIG. 4 is a block diagram schematically showing the construction of an LCD controller shown in FIG. 1.

FIG. 4 shows a schematic construction of the LCD controller shown in FIG. 1.

The LCD controller 60 includes a control circuit 62, a random access memory (as will be abbreviated into the "RAM") (or a storage section in a broad sense) 64, a host input/output circuit (I/O) 66 and an LCD input/output circuit 68. Moreover, the control circuit 62 includes a command sequencer 70, a command setting register 72 and a control signal generation circuit 74.

In accordance with the contents set by the host, the control circuit 62 makes the various action mode settings and the synchronous controls of the signal driver 30, the scan driver 50 and the power circuit 80. In accordance with the instructions from the host, more specifically, the command sequencer 70 is based on the contents set by the command setting register 72, to generate synchronous timing in the control signal generation circuit 74 and to set a predetermined action mode for the signal driver or the like.

The RAM 64 has a function as a frame buffer for the image display and provides a work area for the control circuit 62.

This LCD controller 60 is fed through the host I/O 66 with the image data and the command data for controlling the signal driver 30 and the scan driver 50. With the host I/O 66, there is connected a CPU, a digital signal processor (DSP) or a micro processor section (MPU), although not shown.

The LCD controller 60 is fed with the image data such as still image data from the not-shown CPU and moving image data from the DSP or MPU. The LCD controller 60 is further fed from the not-shown CPU with the command data such as the contents of the register for controlling the signal driver 30 or the scan driver 50 and the data for setting the various action modes.

The image data and the command data may be fed individually through different data buses, or these data buses maybe shared. In this case, the image data and the command data can be easily shared to reduce the packaging area, by making it possible to discriminate whether the data on the data bus are the image data or the command data, from the signal level inputted to the command (CoMmanD: CMD) terminal.

The LCD controller 60 latches the image data, when fed, in the RAM 64 acting as the frame buffer. On the other hand, the LCD controller 60 latches the command data, when fed, in the command setting register 72 or the RAM 64.

In the command sequencer 70, the various timing signals are generated by the control signal generation circuit 74 in accordance with the contents set by the command setting register 72. Moreover, the command sequencer 70 sets the mode of the signal driver 30, the scan driver 50 or the power circuit 80 through the LCD input/output circuit 68 in accordance with the contents set in the command setting register 72.

In response to the display timing generated by the control signal generation circuit 74, moreover, the command sequencer 70 generates the image data of the predetermined type from the image data stored in the RAM, and feeds the generated data to the signal driver 30 through the LCD input/output circuit 68.

1.2 Inverted Drive Method

In case the liquid crystal is to be driven for the display, it is necessary from the viewpoint of the durability or contrast of the liquid crystal to periodically discharge the charge stored in the liquid crystal capacitor. In the aforementioned liquid crystal device 10, therefore, the polarities of the voltage to be applied to the liquid crystal are inverted for a predetermined period by an AC drive. This AC drive method is exemplified by a frame-inverted drive method or a line-inverted drive method.

In the frame-inverted drive method, the polarities of the voltage to be applied to the liquid crystal capacitor are inverted for every frames. In the line-inverted drive method, on the other hand, the polarities of the voltage to be applied to the liquid crystal capacitor are inverted for every lines. In the line-inverted drive method, too, the polarities of the voltage to be applied to the liquid crystal capacitor are inverted for the frame periods if the individual lines are noted.

Figure 5A:
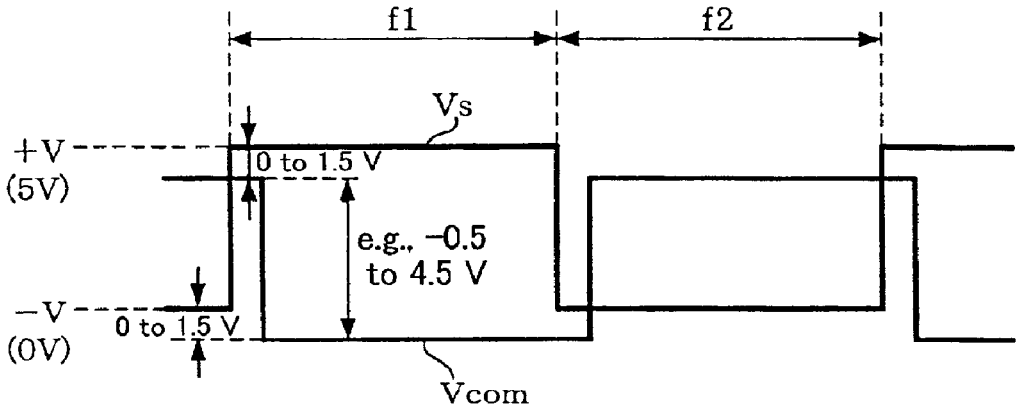
FIG. 5A is a schematic diagram schematically showing waveforms of a drive voltage of a signal line and a counter electrode voltage Vcom according to a frame inverted drive method.
Figure 5B:
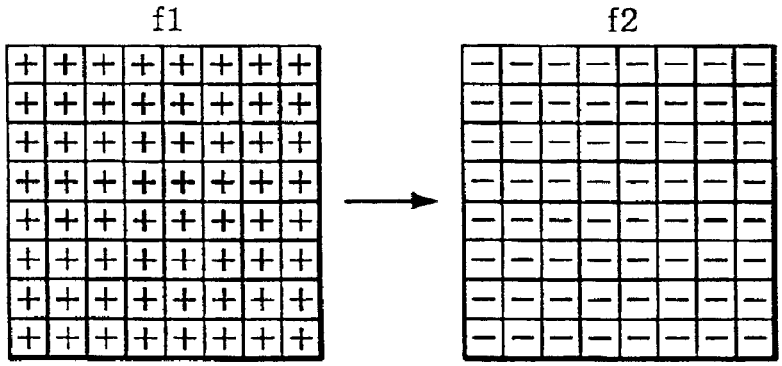
FIG. 5B is a schematic diagram schematically showing the polarities of a voltage to be applied to liquid crystal capacitors corresponding to individual pixels for each frame when the frame inverted drive method is done.

FIGS. 5A and 5B are diagrams for explaining the actions of the frame-inverted drive method. FIG. 5A schematically shows the waveforms of the drive voltage and the counter electrode voltage Vcom of the signal lines by the frame-inverted drive method. FIG. 5B schematically shows the polarities of the voltage to be applied to the liquid crystal capacities corresponding to the individual pixels, for every frames when the frame-inverted drive method is done.

In the frame—inverted drive method, the polarity of the drive voltage to be applied to the signal line is inverted for each frame period, as shown in FIG. 5A. Specifically, a voltage $V_s$ to be fed to the source electrode of the TFT connected with the signal line takes a positive polarity "+V" for a frame f1 and a negative polarity "−V" for a subsequent frame f2. On the other hand, the counter electrode voltage Vcom to be fed to the counter electrode opposed to the pixel electrode connected with the drain electrode of the TFT is also inverted in synchronism with the polarity inverting period of the drive voltage of the signal line.

The liquid crystal capacitor is fed with the difference between the voltages of the pixel electrode and the counter electrode so that the voltage of the positive polarity is applied for the flame f1 whereas the voltage of the negative polarity is applied for the frame f2, as shown in FIG. 5B.

Figure 6A:
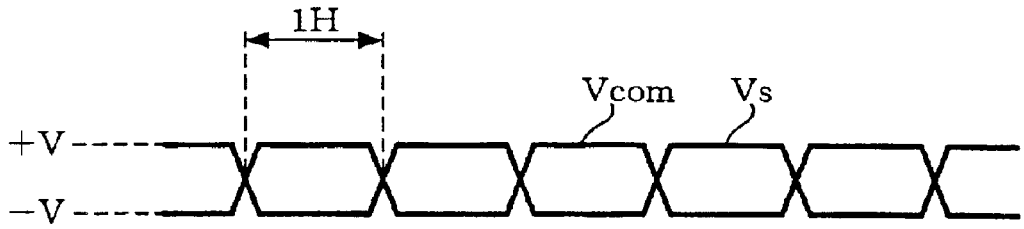
FIG. 6A is a schematic diagram schematically showing waveforms of a drive voltage of a signal line and a counter electrode voltage Vcom according to a line inverted drive method.
Figure 6B:
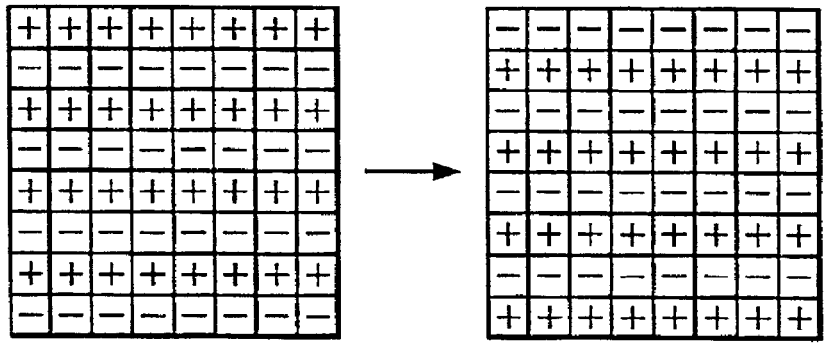
FIG. 6B is a schematic diagram schematically showing the polarities of a voltage to be applied to liquid crystal capacitors corresponding to individual pixels for each frame when the line inverted drive method is done.

FIGS. 6A and 6B are diagrams for explaining the actions of the line-inverted drive method.

FIG. 6A schematically shows the waveforms of the drive voltage and the counter electrode voltage Vcom of the signal lines by the line-inverted drive method. FIG. 6B schematically shows the polarities of the voltages to be applied to the liquid crystal capacities corresponding to the individual pixels, for every frames when the line-inverted drive method is done.

In the line-inverted drive method, the polarity of the drive voltage to be applied to the signal line is inverted for each horizontal scanning period (1H), as shown in FIG. 6A. Specifically, the voltage Vs to be fed to the source electrode of the TFT connected with the signal line takes the positive polarity "+V" for 1H of the frame f1 and the negative polarity "−V" for 2H. Here, the voltage VS takes the negative polarity "−V" for 1H of the frame f2 and the positive polarity "+V" for 2H.

On the other hand, the counter electrode voltage Vcom to be fed to the counter electrode opposed to the pixel electrode connected with the drain electrode of the TFT is also inverted in synchronism with the polarity inverting period of the drive voltage of the signal line.

The liquid crystal capacitor is fed with the difference between the voltages of the pixel electrode and the counter electrode so that the voltage to have its polarity inverted for each line is applied for the frame period, as shown in FIG. 6B, by inverting the polarity for each scan line.

Generally, the line-inverted drive method can make more contribution to an improvement in the image quality but consumes a more power than the frame-inverted drive method, because the it changes for one line period.

1.3 Liquid Crystal Drive Waveforms

Figure 7:
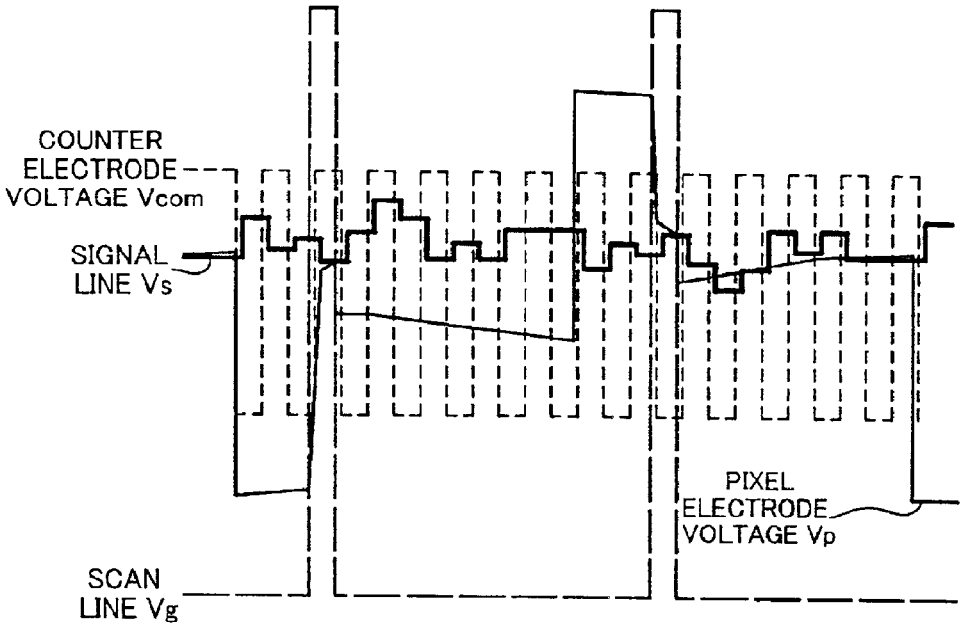
FIG. 7 is an explanatory diagram showing one example of drive waveforms of an LCD panel of a liquid crystal device.

FIG. 7 shows one example of the drive waveforms of the LCD panel 20 of the liquid crystal device 10 having the construction thus far described. Here is shown the case of the drive according to the line-inverted drive method.

In the liquid crystal device 10, the signal driver 30, the scan driver 50 and the power circuit 80 are controlled according to the display timing generated by the LCD controller 60, as has been described hereinbefore. The LCD controller 60 transfers the image data sequentially at one horizontal scanning section to the signal driver 30 and feeds the horizontal synchronizing signal generated therein and a polar inverting signal POL indicating the inverted drive timing. Moreover, the LCD controller 60 feeds the vertical synchronizing signal generated therein to the scan driver 50. Moreover, the LCD controller 60 feeds a counter electrode voltage polarity inverting signal VCOM to the power circuit 80.

As a result, the signal driver 30 is synchronized with the horizontal synchronizing signal, to drive the signal line on the basis of the image data of one horizontal scanning section. The scan driver 50 is triggered by the vertical synchronizing signal scans and drives the scan lines connected with the gate electrodes of the TFTs arranged in the matrix shape in the LCD panel 20, sequentially a drive voltage Vg. The power circuit 80 feeds the counter electrode voltage Vcom generated therein, to the individual counter electrodes of the LCD panel 20 while being polarity-inverted in synchronism with the counter electrode voltage polarity inverting signal VCOM.

The liquid crystal capacitor is charged with an electric charge according to the voltage Vcom between the pixel electrode connected with the drain electrode of the TFT and the counter electrode. When a pixel electrode voltage Vp latched by the electric charge stored in the liquid crystal capacitor exceeds a predetermined threshold value $V_{CL}$, therefore, the image display can be made. When the pixel electrode voltage Vp exceeds the threshold value $V_{CL}$, the transmission factor of the pixel changes according to the voltage level so that the gradation expression can be made.

2. Scan Driver 2.1 Scanning Drive Control on a Block Basis

The scan driver 50 in this embodiment is enabled to realize the partial display by sequentially scanning and driving the individual scan lines of a designated block on a block basis divided for a predetermined number of signal lines.

More specifically, the scan driver 50 in this embodiment sequentially scans and drives the scan lines corresponding to the display areas set on a block basis but not the scan lines corresponding to the non-display area on a block basis. Thus, it is possible to omit the scanning drive of the unnecessary non-display area thereby to save the power consumption. Therefore, the battery-driven electronic device can be used for a longer time than the prior art if it adopts the active matrix type liquid crystal panel using the TFT for a higher image quality.

In this embodiment, this block is given eight pixel units. Therefore, the display area of the LCD panel 20 can be set at the unit of a character letter (of 1 byte). In the electronic device such as the mobile telephone for displaying character letters, therefore, it is possible to set an efficient display area and to display its image.

Figure 8A:
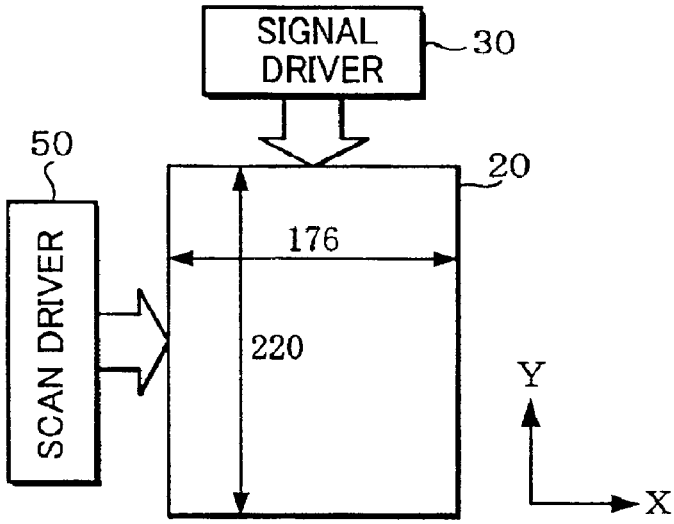
FIGS. 8A, 8B and 8C are explanatory diagrams schematically showing one example of a partial display realized by the scan driver in the embodiment.
Figure 8B:
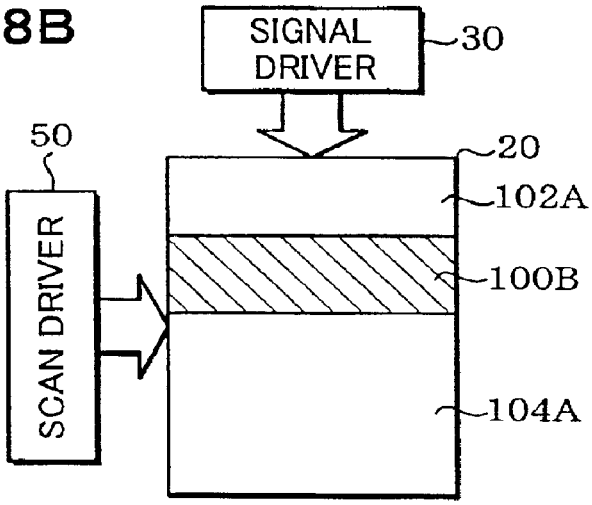
Figure 8C:
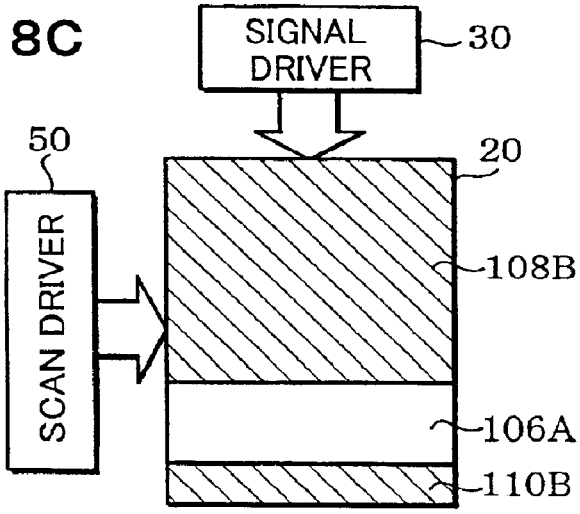

FIGS. 8A, 8B and 8C schematically show one example of the partial display which is realized by the scan driver in this embodiment.

With respect to the LCD panel 20, as shown in FIG. 8A, for example, the signal driver 30 is arranged with a plurality of signal lines being arrayed in the Y-direction, and the scan driver 50 is arranged with a plurality of scan lines being arrayed in the X-direction. In this case, a non-display area 100B is set on a block basis, as shown in FIG. 8B. Thus, only the signal lines of the blocks corresponding to display areas 102A and 104A may be drive on the basis of the image data.

Alternatively, by setting a display area 106A on a block basis, as shown in FIG. 8C, the signal lines of the blocks corresponding to non-display areas 108B and 110B need not be driven on the basis of the image data. Moreover, a plurality of non-display areas or display areas may be set in FIGS. 8B and 8C.

Figure 9A:
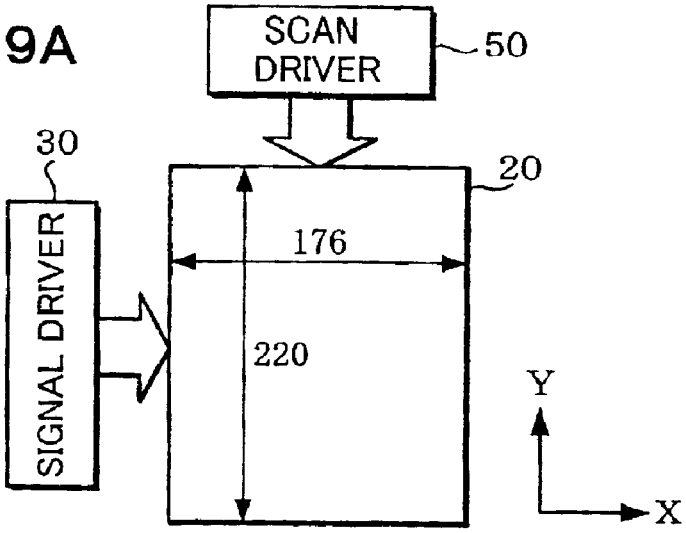
FIGS. 9A, 9B and 9C are explanatory diagrams schematically showing another example of a partial display realized by the scan driver in the embodiment.
Figure 9B:
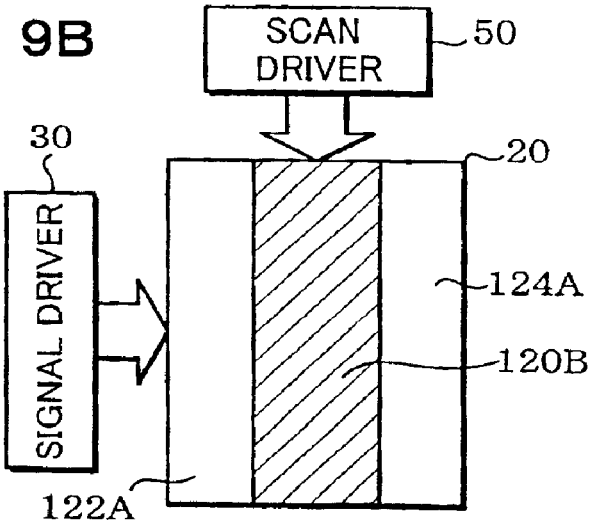
Figure 9C:
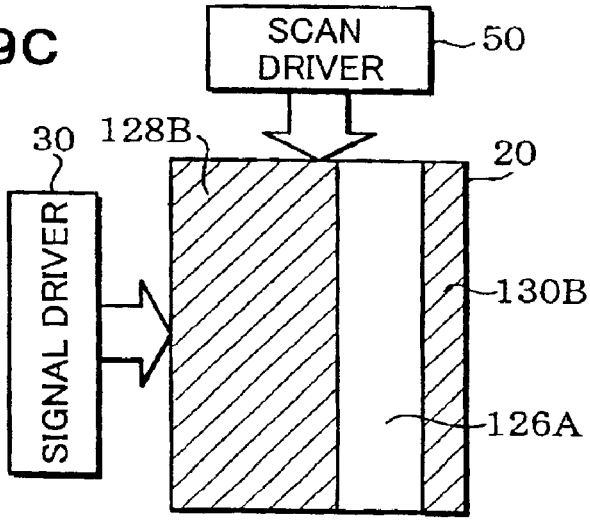

FIGS. 9A, 9B and 9C schematically show another example of the partial display which has been realized by the scan driver according to this embodiment.

In this case, with respect to the LCD panel 20, as shown in FIG. 9A, the signal driver 30 is arranged with a plurality of signal lines being arrayed in the X-direction, and the scan driver 50 is arranged with a plurality of scan lines being arrayed in the Y-direction. By setting a non-display area 120B on a block basis, as shown in FIG. 9B, only the scan lines of the blocks corresponding to display areas 122A and 124A may be sequentially scanned and driven.

Alternatively, by setting a display area 126A on a block basis, as shown in FIG. 9C, the scan lines of the blocks corresponding to the non-display areas 128B and 130B need not be scanned and driven on the basis of the image data. Here in FIGS. 9B and 9C, a plurality of non-display areas or display areas may be set.

Moreover, each display area may be divided into a still image display area and a moving image display area, for example. Thus, it is possible to provide a screen easy for the user to observe, and to lower the power consumption.

2.2 Refresh

The dynamically switchable partial display control has never been made in the active matrix type liquid crystal panel using the TFT. From the relation to the lifetime of the liquid crystal, as described hereinbefore, the AC drive has been done for every sixtieth seconds, for example. However, the liquid crystal is degraded if the gate electrode is turned ON with the liquid crystal capacitor being charged. It is, therefore, necessary to release the charge stored in the liquid crystal capacitor. In the active matrix type liquid crystal panel using the TFT, therefore, the voltage difference between the pixel electrode and the counter electrode of the liquid crystal capacitor is set to 0 for the non-display area.

Here, the liquid crystal capacitor is gradually stored with the electric charge by the leakage of the TFT. Even the OFF state of the gate electrode of the TFT is kept, therefore, the charge exceeding the threshold value VCL is finally stored. As a result, the transmission factor of the pixel changes into a gray display, for example, so that the so-called "partial display" cannot be made.

In other words, the partial display control method, as could be easily realized in the case of the passive matrix type liquid crystal panel using the STN liquid crystal so long as it is not scanned and driven, cannot be applied as it is to the active matrix type liquid crystal panel using the TFT. In case the non-display area is set in the active matrix type liquid crystal panel using the TFT, therefore, it has to be set in a fixed manner from the power ON so that the dynamically switchable partial display control cannot be made.

In this embodiment, on the contrary, the dynamically switchable partial display control is realized by controlling the voltage of the gate electrode of the TFT. By this partial display control, moreover, the electric power to be consumed by the scanning drive of the non-display area can be lowered or reduced.

More specifically, the scan driver 50 in this embodiment scans and drives the scan lines as set in the display area on a block basis, for one frame period, and scans and drives all the scan lines including the scan lines set in the non-display area on a block basis, for an arbitrary odd frame period of three or more frames.

Figure 10A:
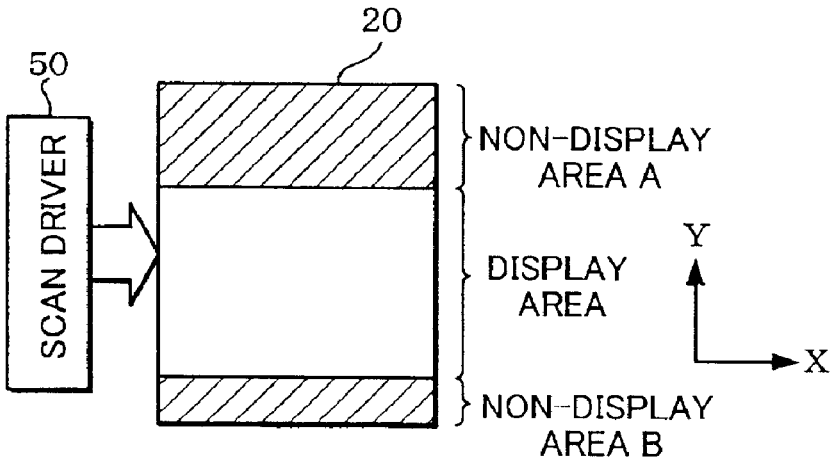
FIGS. 10A and 10B are explanatory diagrams showing one example of the actions of the scan driver in the embodiment.
Figure 10B:
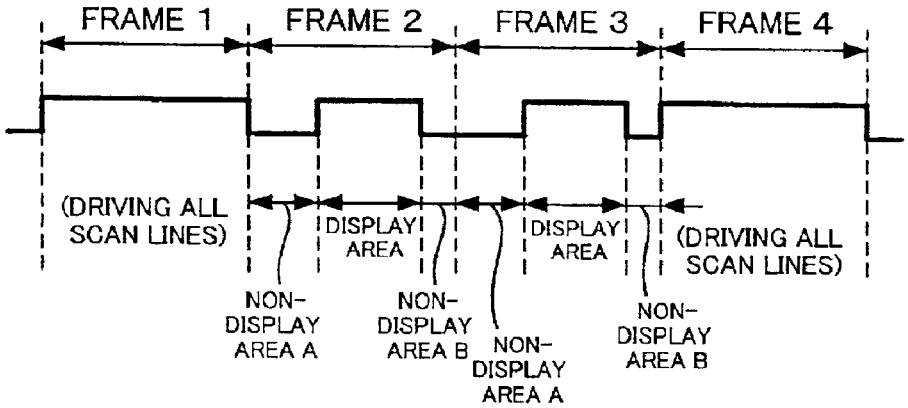

FIGS. 10A and 10B show one example of the actions of the scan driver 50 in this embodiment.

For example, it is assumed that a display area and non-display areas A and B are set on a block basis, as shown in FIG. 10A, in case a plurality of scan lines are arrayed in the Y-axis direction of the LCD panel 20.

In case the frame to sequentially scan and drive all the scan lines of the blocks of the display area and the non-display areas A and B is located at the first frame, the scan driver 50 in this embodiment scans and drives all the scan lines of the LCD panel 20 sequentially at the two-frame spaced fourth frame, as shown in FIG. 10A. In short, all the scan lines of the LCD panel 20 are scanned and driven for the three-frame period, as shown in FIG. 10B.

In case polarity of the applied voltage of the first-frame liquid crystal capacitor is positive, for example, the polarity of the applied voltage of the fourth-frame liquid crystal capacitor is negative, and the polarity of the applied voltage of the 7th-frame liquid crystal capacitor is positive. Thus, it is possible to realize the AC drive. At the second frame and the third frame between the frames (i.e., the first frame and the fourth frame) for scanning and driving all the scan lines, moreover, the scan lines corresponding to the non-display areas A and B are not scanned and driven so that the power consumption can be accordingly reduced.

In case the AC drive is done for the frame period in the active matrix type liquid crystal panel using the TFT, therefore, the power consumption can be reduced by inverting the polarities of the voltage to be applied to the liquid crystal capacitor and by reducing the unnecessary scanning drive.

Here will be described a specific construction example of the scan driver 50 in this embodiment.

Figure 11:
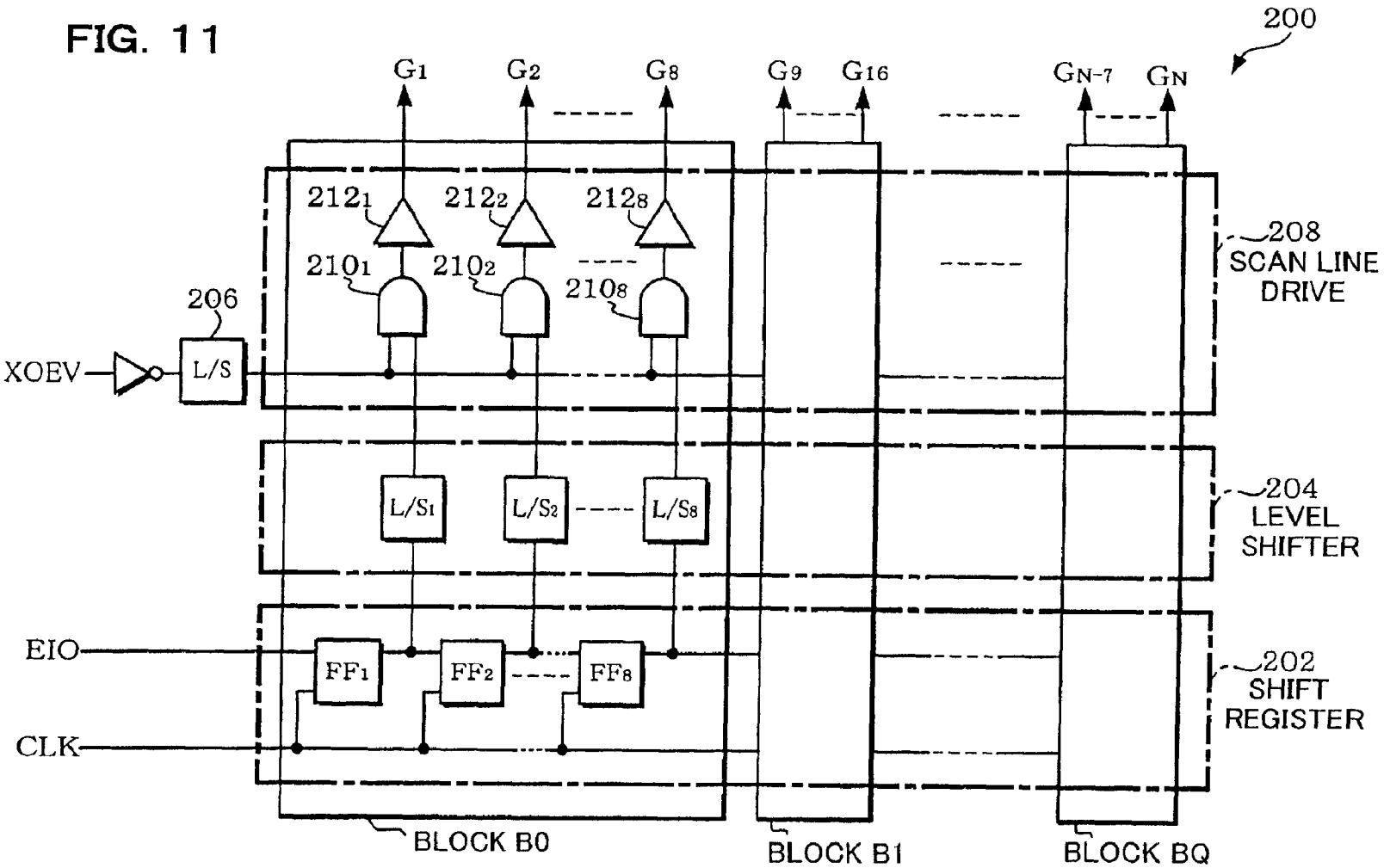
FIG. 11 is a block diagram showing a schematic construction of the scan driver in a first construction example.

3. Specific Example of Construction of Scan driver in Embodiment 3.1 First Construction Example FIG. 11 shows a schematic construction of the scan driver in the first construction example.

A scan driver 220 in the first construction example includes a shift register 202, L/S 204 and 206, and a scan line drive circuit 208.

In the shift register 202, there are connected in series flip-flops (as will be abbreviated into the "FF") $FF_1$ to $FF_N$ (i.e. , the first to Nth FF) which correspond to the scan lines $G_1$ to $G_N$ (i.e. , the first to Nth scan lines), respectively. The $FF_1$ (i.e., the first FF) is fed with the enable input/output signal EIO from the LCD controller 60. Moreover, the $FF_1$ to $FF_N$ are likewise fed with the clock signal CLK from the LCD controller 60. Therefore, the $FF_1$ to $FF_N$ shift the enable input/output signal EIO (i.e., a predetermined pulse signal) in synchronism with the clock signal CLK.

The enable input/output signal EIO fed from the LCD controller 60 is a vertical synchronizing signal. On the other hand, the clock signal CLK fed from the LCD controller 60 is a horizontal synchronizing signal.

The L/S 204 has level shifter circuits $LS_1$ to $LS_N$ (i.e., the first to Nth level shifters) corresponding to the scan lines $G_1$ to $G_N$, respectively, and shifts the voltage levels on the high potential sides of the held data of the corresponding $FF_1$ to $FF_N$, to 20 to 50 V, for example.

The L/S 206 shifts the voltage level on the high potential side of the inverted signal of the output enable signal XOEV fed from the LCD controller 60, to 20 to 50 V.

The scan line drive circuit 208 includes AND circuits $\mathbf{210}_1$ to $\mathbf{210}_N$ as mask circuits, and CMOS buffer circuits $\mathbf{212}_1$ to $\mathbf{212}_N$, individually for the scan lines $G_1$ to $G_N$. The AND circuits $\mathbf{210}_1$ to $\mathbf{210}_N$ and the CMOS buffer circuits $\mathbf{212}_1$ to $\mathbf{212}_N$ are formed by the high pressure-resisting process which can be operated at the aforementioned voltage level of 20 to 50 V. Here, this voltage level is determined according to a liquid crystal material, for example, for the LCD panel 20 to be driven.

The scan driver 200 thus constructed scans and drives the scan lines set in the display area, sequentially under the timing control of the output enable signal XOEV fed from the LCD controller 60.

Specifically, the LCD controller 60, for which the display area of the LCD panel 20 is wholly set as the display area by the not-shown host, feeds the vertical synchronizing signal for a predetermined vertical scanning period and the horizontal synchronizing signal for a predetermined horizontal scanning period, individually, to the scan driver 200. At this time, the LCD controller 60 is left in the logic level "L" of the output enable signal XOEV so that the CMOS buffer circuits $\mathbf{212}_1$ to $\mathbf{212}_N$ drive the individual scan lines $G_1$to $G_N$ sequentially at the potentials corresponding to the logic levels of the $LS_1$ to $LS_N$.

On the other hand, the LCD controller 60, for which the non-display area is set in the display region of the LCD panel 20, feeds the scan driver 200 with the vertical synchronizing signal and the horizontal synchronizing signal at the same timing as the aforementioned one, and the output enable signal XOEV which take the logic level "H" in synchronism with the scanning timing of the scan lines corresponding to the non-display area.

Specifically, the scan lines $G_1$ to $G_N$ are selectively driven so that the logic level of the output node of the LS is masked to the logic level "L" by feeding the output enable signal XOEV at the scanning timing corresponding to the non-display area. Therefore, those scan lines are not driven. In the first construction example, the partial display control is made by setting the unit of eight scan lines to one block. Therefore, the LCD controller 60 feeds the scan driver 200 with the output enable signal XOEV controlled on a block basis.

Figure 12:
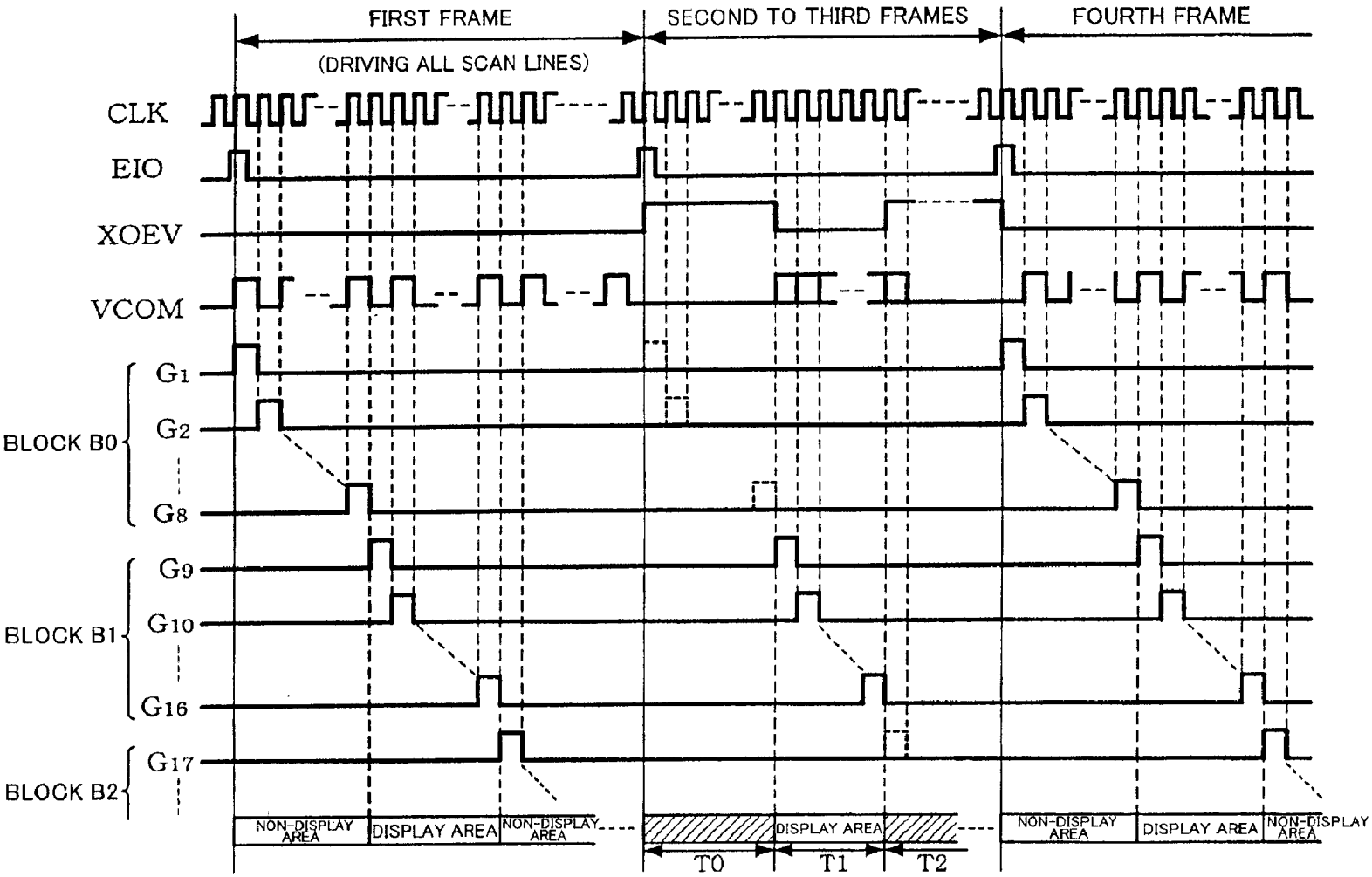
FIG. 12 is a timing chart showing one example of a partial display control timing by the scan driver in the first construction example.

FIG. 12 shows one example of the partial display control timing by the scan driver 200 in the first construction example.

Here, it is assumed that only a block B1 is set at the display area whereas the remaining blocks B0, B2, - - - , and so on are set at the non-display areas.

In order to prevent the liquid crystal from being degrading, as described above, it is necessary to release the electric charge, as stored in the liquid crystal capacitor connected with the TFT, at a predetermined frequency. The scan driver 200 drives all the scan lines of the LCD panel 20 sequentially at odd ($2^i-1$, wherein i is a natural number) frame periods. In case all the scan lines of the liquid crystal panel 20 are sequentially driven for one frame period (i=1), the scan driver 200 cannot acquire the effect for a lower power consumption, as might otherwise accompany the partial display control. The period is desired to be longer than a three-frame period. This frame period depends on the liquid crystal material but can be set the longer for the lower scanning drive voltage. Here, FIG. 12 shows the case in which all the scan lines are sequentially driven for the three (i=2) frame period.

In short, the scan driver 200 scans and drives all the scan lines sequentially at the first frame and at the fourth frame.

If the scan driver 200 fetches the enable input/output signal EIO at the first frame and the fourth frame in synchronism with the clock signal CLK, more specifically, the scan driver 200 shifts the $FF_1$ to $FF_N$ of the shift register 202 sequentially. The LCD controller 60 feeds the scan driver 200 with the output enable signal XOEV having the logic level "L" in accordance with the scanning timing of the scan lines of the individual blocks. In the scan driver 200, the AND circuits $\mathbf{210}_1$ to $\mathbf{210}_N$ of the scan line drive circuit 208 feeds the potentials at the output nodes of the $LS_1$ to $LS_N$ as they are to the CMOS buffer circuits $\mathbf{212}_1$ to $\mathbf{212}_N$. Therefore, the scanning drives are sequentially done at the gate electrodes of the TFTs connected with the scan lines $G_1$ to $G_N$ so that the potentials connected with the signal lines are applied to the liquid crystal capacitor. At this time, such a voltage is applied to the pixel electrode of the liquid crystal capacitor that the voltage difference from the counter electrode voltage Vcom of the liquid crystal capacitor may be smaller than a predetermined threshold value VCL. Alternatively, a voltage equivalent to the counter electrode voltage Vcom of the liquid crystal capacitor can also be applied to the pixel electrode of the liquid crystal capacitor.

Moreover, the scan driver 200 scans and drives only the scan lines corresponding to the display area sequentially at the second frame and the third frame between the aforementioned first and fourth frames, but does not drive the scan lines corresponding to the non-display area.

When the scan driver 200 fetches the enable input/output signal EIO at the second frame and the third frame in synchronism with the clock signal CLK, more specifically, it shifts the $FF_1$ to $FF_N$ of the shift register 202 sequentially. The liquid crystal controller 60 feeds the scan driver 200 with the output enable signal XOEV having the logic level "H" in accordance with the scanning timing T0 of the scan lines $G_1$ to $G_8$ of the block B0 set in the non-display area. In the scan driver 200, therefore, the AND circuits $\mathbf{210}_1$ to $\mathbf{210}_8$ of the scan line drive circuit 208 masks the logic levels of the output nodes of the $LS_1$ to $LS_8$ to set the logic level to "L". As a result, the gate electrodes of the TFTs connected with the scan lines $G_1$ to $G_8$ are left at the potential on the lower potential side.

Moreover, the LCD controller 60 feeds the scan driver 200 with the output enable signal XOEV having the logic level "L" in accordance with the scanning timing T1 of the scan lines $G_9$ to $G_{16}$ of the block B1 set in the display area. In the scan driver 200, the AND circuits $\mathbf{210}_9$ to $\mathbf{210}_{16}$ of the scan line drive circuit 208 feed the potentials of the output nodes of the $LS_9$ to $LS_{16}$ as they are to the CMOS buffer circuits $\mathbf{212}_9$ to $\mathbf{212}_{16}$. As a result, the gate electrodes of the TFTs connected with the scan lines $G_9$ to $G_{16}$ are sequentially scanned and driven so that the potentials connected with the signal lines are applied to the liquid crystal capacitors.

Moreover, the LCD controller 60 feeds the scan driver 200 with the output enable signal XOEV having the logic level "H" in accordance with the scanning timing T2 of the scan lines $G_{17}$ to $G_{24}$ Of the block B2 set in the non-display area, to interrupt the drive of the scan lines as at the scanning timing T1.

Other Refresh Timing

The LCD controller 60 for feeding such output enable signal XOEV to the scan driver 200 receives the command or the image data from the not-shown host, and controls the scan driver 200 and the signal driver 30 in accordance with the received contents.

Figure 13:
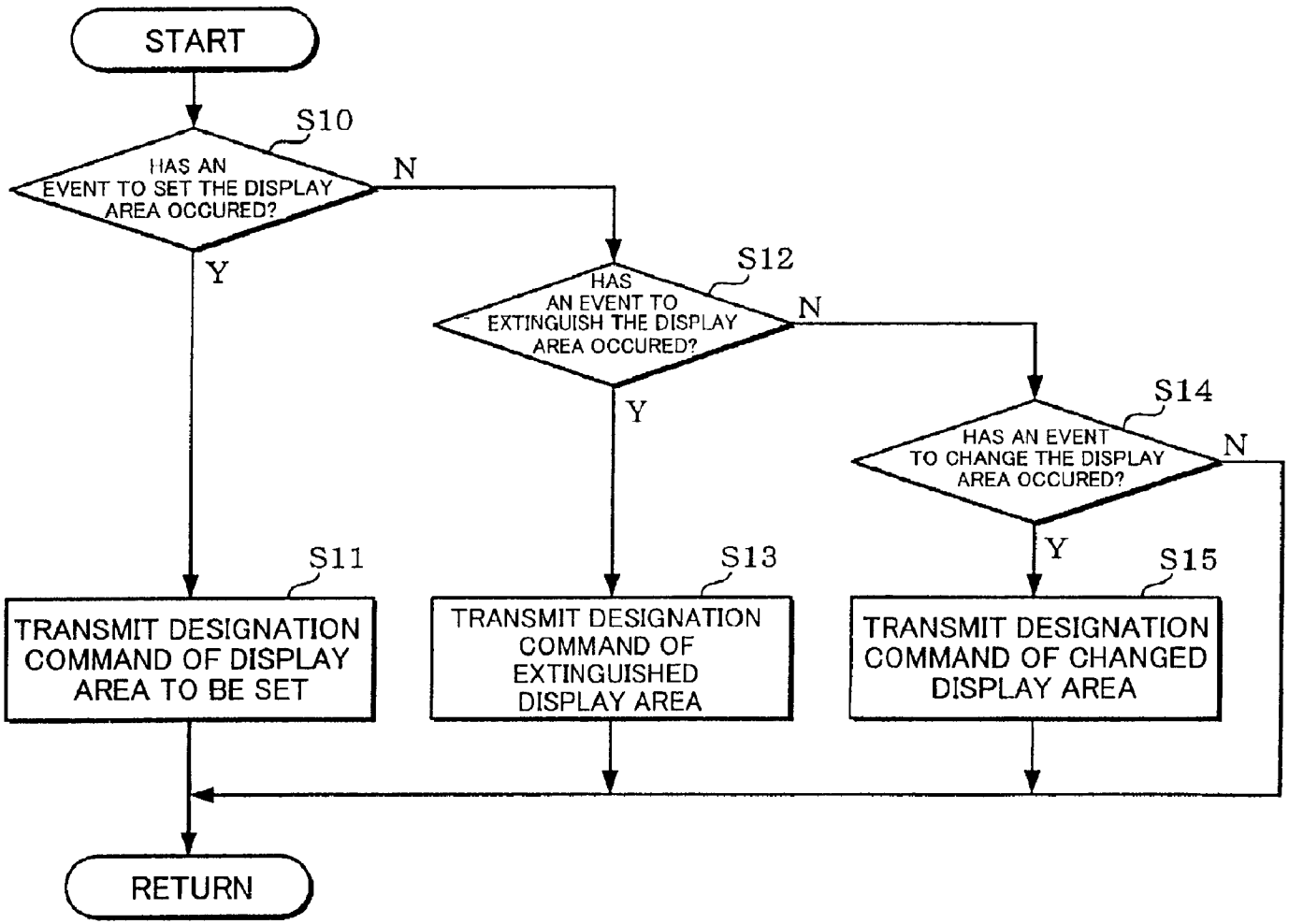
FIG. 13 is a flow chart showing one example of the content contents of the partial display control to be made by a host.

FIG. 13 shows one example of the control contents of the partial display control to be made by the host.

According to the programs stored in a memory or the like, the not-shown host (e.g., a CPU) monitors (Step S10: N, Step S12: N, and Step S14: N) the occurrences of a display area setting event, a display area extinguishing event or a display area changing event.

If the host detects the occurrence of the display area setting event (Step S10: Y), it transmits (at Step S11) a command to designate the scan lines to set the display area, to the LCD controller 60, and monitors a next event occurrence (Return).

If the LCD controller 60 receives the command designated at Step S11, it sets the logic level of the output enable signal XOEV to "L" in the control signal generation circuit 74 under the control of the command sequencer 70, and scans and drives all the scan lines for refreshing. The LCD controller 60 sets the refreshed frame as the first frame shown in FIG. 12. At the second and later frames, the partial display control is made at the timing shown in FIG. 12 in accordance with the scan lines corresponding to the display area designated by the host.

If the host detects the occurrence of the display area extinguishing event (Step S10: N, and Step S12: Y), it transmits the command for updating the display area to the LCD controller 60 (at Step S13), and monitors the next event occurrence (Return).

If the LCD controller 60 receives the command designated at Step S13, it sets the logic level of the output enable signal XOEV to "L" in the control signal generation circuit 74 under the control of the command sequencer 70, and scans and drives all the scan lines for refreshing. The LCD controller 60 sets the refreshed frame as the first frame shown in FIG. 12. At the second and later frames, the partial display control is made at the timing shown in FIG. 12 in accordance with the scan lines corresponding to the extinguished display area designated by the host.

If the host detects the occurrence of the display area changing event (Step S10: N, and Step S12: Y), it transmits the command for updating the display area to the LCD controller 60 (at Step S15), and monitors the next event occurrence (Return).

If the LCD controller 60 receives the command designated at Step S15, it sets the logic level of the output enable signal XOEV to "L" in the control signal generation circuit 74 under the control of the command sequencer 70, and scans and drives all the scan lines for refreshing. The LCD controller 60 sets the refreshed frame as the first frame shown in FIG. 12. At the second and later frames, the partial display control is made at the timing shown in FIG. 12 in accordance with the scan lines corresponding to the changed display area designated by the host.

Each time the event to update the set value of the display area is thus detected, all the scan lines are sequentially scanned and driven as the first frame, as shown in FIG. 12, so that a proper partial display control can be made by avoiding the liquid crystal degradation and by minimizing the scanning drive of the non-display area.

3.2 Second Construction Example

In the first construction example, the scan driver makes the partial display control in accordance with the timing controlled by the LCD controller. The scan driver in the second construction example is not controlled by the LCD controller but can make the partial display control. For this, the scan driver in the second construction example includes a block select register for holding the block select data designated on a block basis. The scan lines of the individual blocks are turned ON/OFF for the scanning drive on the basis of the block select data which are set to correspond to the individual blocks.

Figure 14:
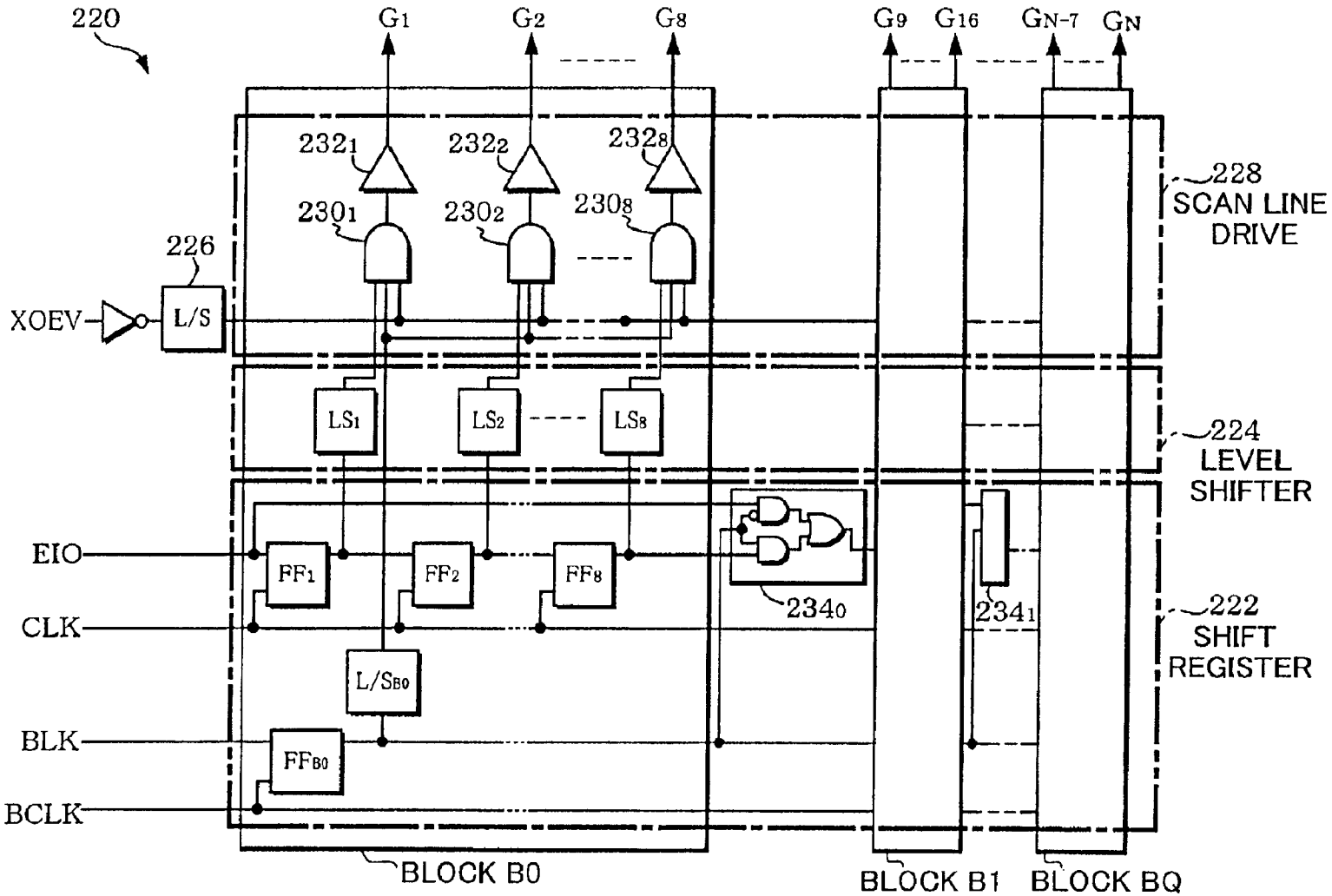
FIG. 14 is a block diagram showing a schematic construction of the scan driver in a second construction example.

FIG. 14 shows a schematic construction of the scan driver in the second construction example.

A scan driver 200 in the second construction example includes a shift register 222, L/S 224 and 226, and a scan line drive circuit 228.

In the shift register 222, there are connected in series $FF_1$ to $FF_N$ (i.e., the first to Nth FF) which correspond to the scan lines $G_1$ to $G_N$ (i.e., the first to Nth scan lines), respectively. The $FF_1$ (i.e., the first FF) is fed with the enable input/output signal EIO from the LCD controller 60. Moreover, the $FF_1$ to $FF_N$ are likewise fed with the clock signal CLK from the LCD controller 60. Therefore, the $FF_1$ to $FF_N$ shift the enable input/output signal EIO (i.e., a predetermined pulse signal) in synchronism with the clock signal CLK.

The enable input/output signal EIO fed from the LCD controller 60 is a vertical synchronizing signal. On the other hand, the clock signal CLK fed from the LCD controller 60 is a horizontal synchronizing signal.

The L/S 224 has level shifter circuits $LS_1$ to $LS_N$ (i.e., the first to Nth LS circuit) corresponding to the scan lines $G_1$ to $G_N$, respectively, and shifts the voltage levels on the high potential sides of the held data of the corresponding $FF_1$ to $FF_N$, to 20 to 50 V, for example.

The L/S 226 shifts the voltage level on the high potential side of the inverted signal of the output enable signal XOEV fed from the LCD controller 60, to 20 to 50 V.

The scan line drive circuit 228 includes AND circuits $\mathbf{230}_1$ to $\mathbf{230}_N$ as mask circuits, and CMOS buffer circuits $\mathbf{232}_1$ to $\mathbf{232}_N$, individually for the scan lines $G_1$ to $G_N$. The AND circuits $\mathbf{230}_1$ to $\mathbf{230}_N$ and the CMOS buffer circuits $\mathbf{232}_1$ to $\mathbf{232}_N$ are formed by the high pressure-resisting process which can be operated at the aforementioned voltage level of 20 to 50 V. Here, this voltage level is determined according to a liquid crystal material, for example, for the LCD panel 20 to be driven.

The AND circuits $\mathbf{230}_1$ to $\mathbf{230}_N$ mask the logic levels of the output nodes of the $FF_1$ to $FF_N$, as level-shifted by the $LS_1$ to $LS_N$, with the output enable signal XOEV level-shifted by the L/S 226 and with the block select data designated on a block basis. In case the block select data is set at "0", more specifically, the logic levels of the output nodes of the $LS_1$ to $LS_N$ are masked to "L" irrespective of the logic level of the output enable signal XOEV. In case the block select data are set at "1", on the other hand, the logic levels of the output nodes of the $LS_1$ to LSN are masked to "L" when the logic level of the output enable signal XOEV is at "L".

The block select data are held in the $FF_{B0}$ to $FF_{BQ}$ provided on a block basis. The $FF_{B0}$ is fed with block select data BLK which are serially inputted from the LCD controller 60. The $FF_{B0}$ to $FF_{BQ}$ are commonly fed from the LCD controller 60 with a clock signal BCLK for fetching the serially inputted block select data BLK. The $FF_{B0}$ to $FF_{BQ}$ shift the block select data BLK fed to the $FF_{B0}$, sequentially in synchronism with the clock signal BCLK.

Moreover, the scan driver 220 in the second construction example is provided with data switching circuits (or bypass sections) $\mathbf{234}_0$ to $\mathbf{234}_{Q-1}$ for bypassing the enable input/output signal EIO on a block basis.

Figure 15A:
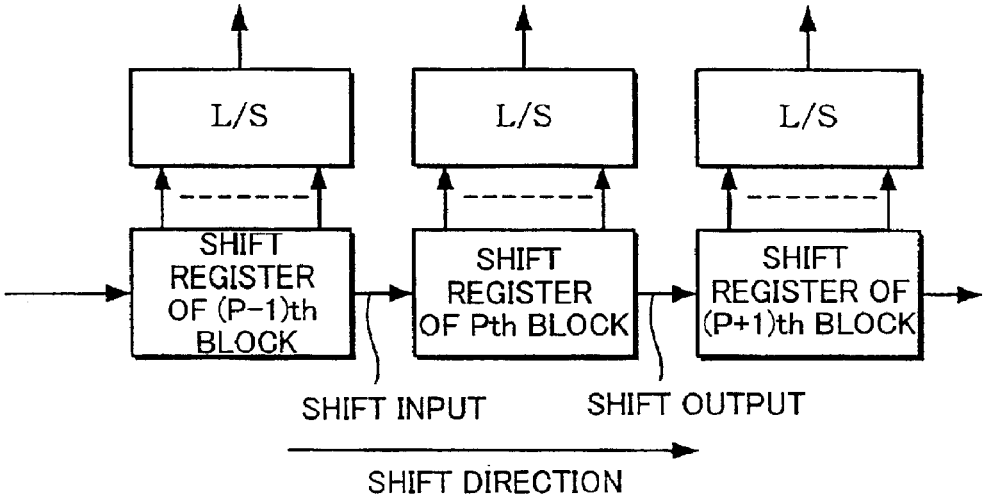
FIGS. 15A and 15B are explanatory diagrams schematically showing the actions of a data switching circuit.
Figure 15B:
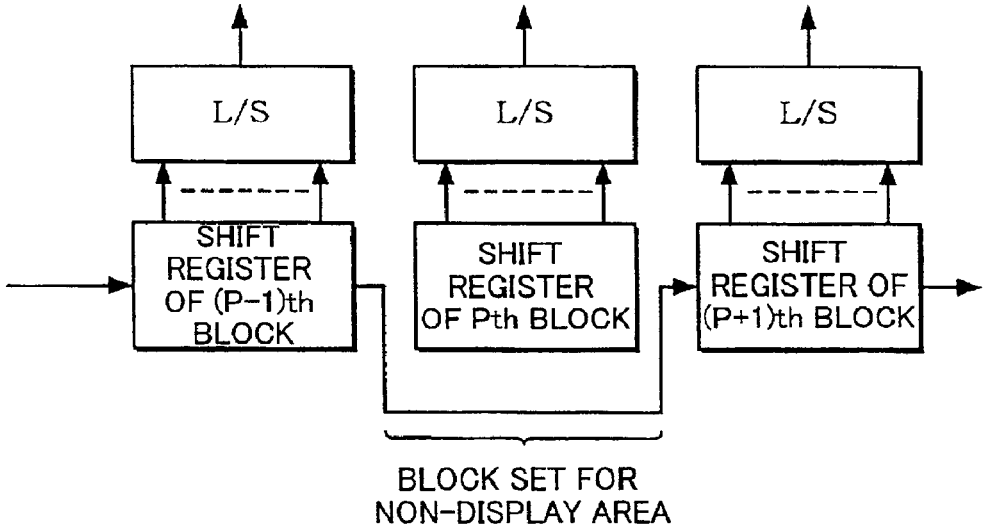

FIGS. 15A and 15B show the actions of the data switching circuit schematically.

A data switching circuit $\mathbf{234}_P$ is provided for the Pth block ($1 \leqq P \leqq Q-1$, P: a natural number). This data switching circuit $\mathbf{234}_p$ shifts, if designated to drive the scan lines by the block select data, the shift inputs from the final stage FF of the (P−1)th block sequentially, as shown in FIG. 15A, and feeds it to the (P+1)th block. Thus, the scan lines of the Pth block are driven on the basis of the shift output of the FF constructing the shift register of the Pth block.

If the data switching circuit $\mathbf{234}_p$ is designated not to drive the scan lines by the block select data, on the other hand, it bypasses the shift input to the FF of the first stage of the Pth block of both the shift input to the FF of the initial stage of the Pth block and the shift output of the FF of the final stage of the Pth block, and feeds it to the (P+1) th block, as shown in FIG. 15B.

If the designation is made not to drive the scan line drive of the block B1 by the block select data, for example, the enable input/output signal EIO to be fed to the $FF_1$ of the block B0 is shifted by the $FF_2$ to $FF_8$ in synchronism with the clock signal CLK, but the shift output of the $FF_8$ is fed to the $FF_{17}$ of the block B2 by the data switching circuit $\mathbf{234}_1$ corresponding to the $FF_9$ of the block B1.

More specifically, the data switching circuit $\mathbf{234}_0$ corresponding to the block B0 switches the shift output (i.e., the enable input/output signal EIO to be fed to the $FF_1$ in the block B0) fed from the block of the preceding stage and the shift output (i.e., the shift output to be outputted from the $FF_8$ in the block B0) of the FF of the final stage of the same block, in accordance with the block select data of the same block. The output signal switched by the data switch circuit $\mathbf{234}_0$ is fed to the block B1.

Here, this data switching circuit is enabled to switch the shift direction of the enable input/output signal EIO by the predetermined shift direction switching signal SHL so that it can be disposed on the opposite side for each block. In this case, there are provided the data switching circuits corresponding to the blocks BQ to B1.

In the scan driver 220 thus constructed, the scan lines set in the display area on a block basis are scanned and driven for one frame period, as described. However, all the scan lines including the scan lines set in the non-display area on a block basis are also scanned and driven for an arbitrary odd frame periods. In the scan driver 220, therefore, the block select data to change the block to be scanned and driven are updated by the LCD controller 60 by utilizing the fly-back period.

In the case of the frames in which all the scan lines of the display area of the LCD panel 20 are driven, more specifically, the LCD controller 60 sets the block select data of all blocks to "1" for the $FF_{B0}$ to $FF_{BQ}$ provided for the individual blocks of the scan driver 220. After this, the LCD controller 60 feeds the vertical synchronizing signal for a predetermined vertical scanning period and the horizontal synchronizing signal for a predetermined scanning period individually to the scan driver 220. At this time, the LCD controller 60 is left in the state of the logic level "L" of the output enable signal XOEV so that the CMOS buffer circuits $\mathbf{232}_1$ to $\mathbf{232}_N$ drive the individual scan lines $G_1$ to $G_N$ at the potentials corresponding to the logic levels of the $LS_1$ to $LS_N$.

In the case of the frame in which only the display area of the LCD panel 20 is scanned and driven by the not-shown host, the LCD controller 60 sets the $FF_{B0}$ to $FF_{BQ}$ for the individual blocks of the scan driver 220 such that the block select data of the block set in the display area may take "1" whereas the block select data of the block set in the non-display area may take "0".

After this, the LCD controller 60 feeds the scan driver 220 with the vertical synchronizing signal and the horizontal synchronizing signal at the same timing as the aforementioned one. At this time, the LCD controller 60 is left in the state of the logic level "L" of the output enable signal XOEV. In case the block select data set on a block basis are "0", therefore, the CMOS buffer circuits $\mathbf{232}_1$ to $\mathbf{232}_N$ take the logic level "L" because the logic level of the output nodes of the LS is masked by the AND circuit, so that they do not drive those scan lines.

Figure 16:
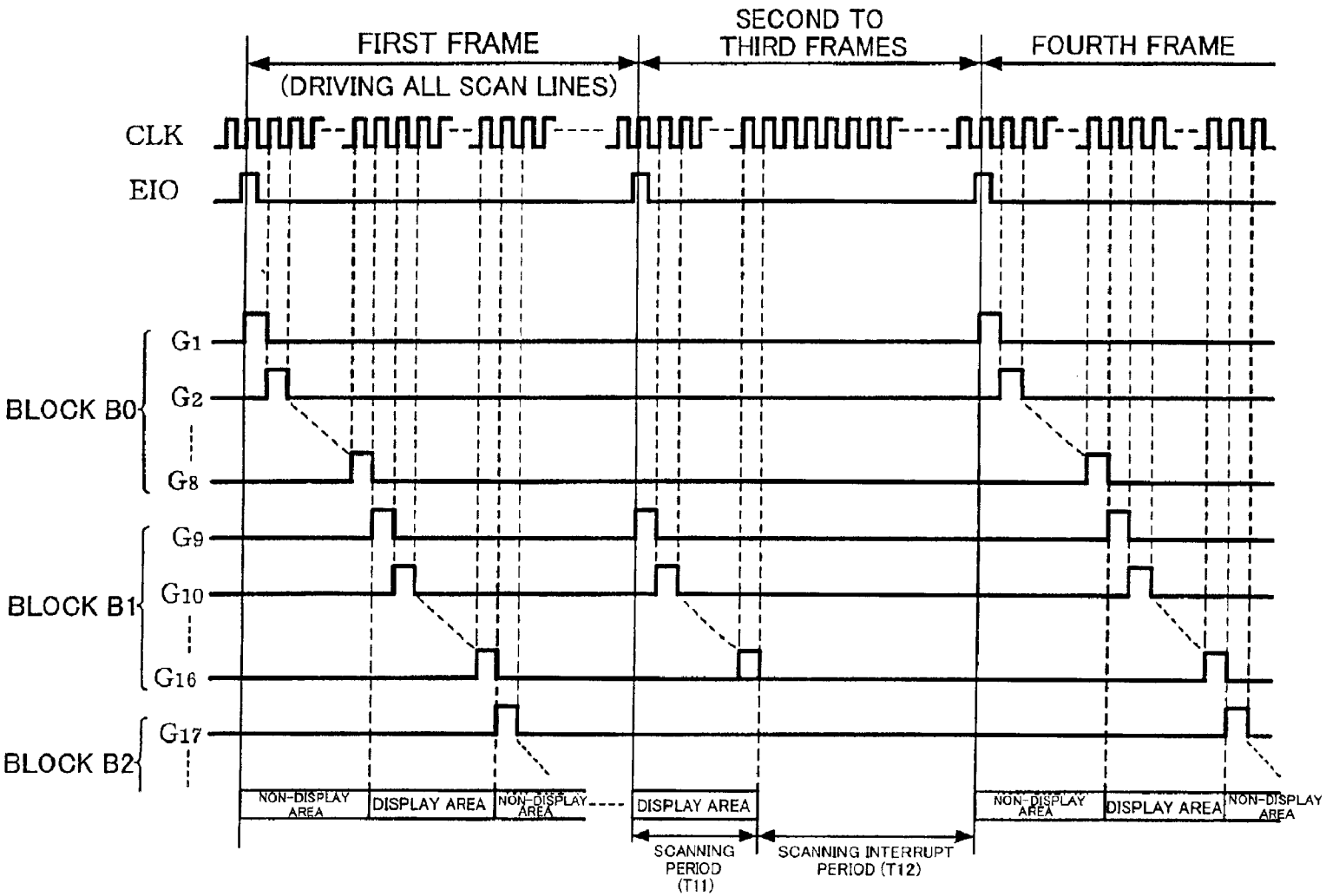
FIG. 16 is a timing chart showing one example of the partial display control timing by the scan driver in the second construction example.

FIG. 16 shows one example of the partial display control timing by the scan driver 220 in the second construction example.

Here, it is assumed that only a block B1 is set at the display area whereas the remaining blocks B0, B2, - - - , and so on are set at the non-display areas.

In the scan driver 220 in the second construction example, as in the first construction example, all the scan lines corresponding to the blocks B0 to BQ are sequentially scanned and driven at the first frame and the fourth frame, and only the scan lines of the block B1 set in the display area are scanned and driven at the second frame and the third frame.

In the scan driver 220, more specifically, at the second frame and the third frame, the enable input/output signal EIO is fed only to the scan lines of the block set in the display area. Therefore, the scan driver 220 scans and drives only a period T11 corresponding to the display area. At this time, the signal driver to be controlled by the LCD controller 60 drives the signal lines on the basis of the image data corresponding to the display area. Thus, it is sufficient to do the drive only at the scanning timing corresponding to the display area, and a scanning drive interrupt period T12 can be provided at the second frame and the third frame.

At the second frame and the third frame, therefore, the scanning drive is not required for the scanning drive interrupt period so that the power consumption can be accordingly reduced.

Thus, it is possible to omit the scanning drive of the unnecessary non-display area thereby to save the power consumption. Therefore, the battery-driven electronic device can adopt the active matrix type liquid crystal panel using the TFT for a higher image quality.

Modification

Figure 17:
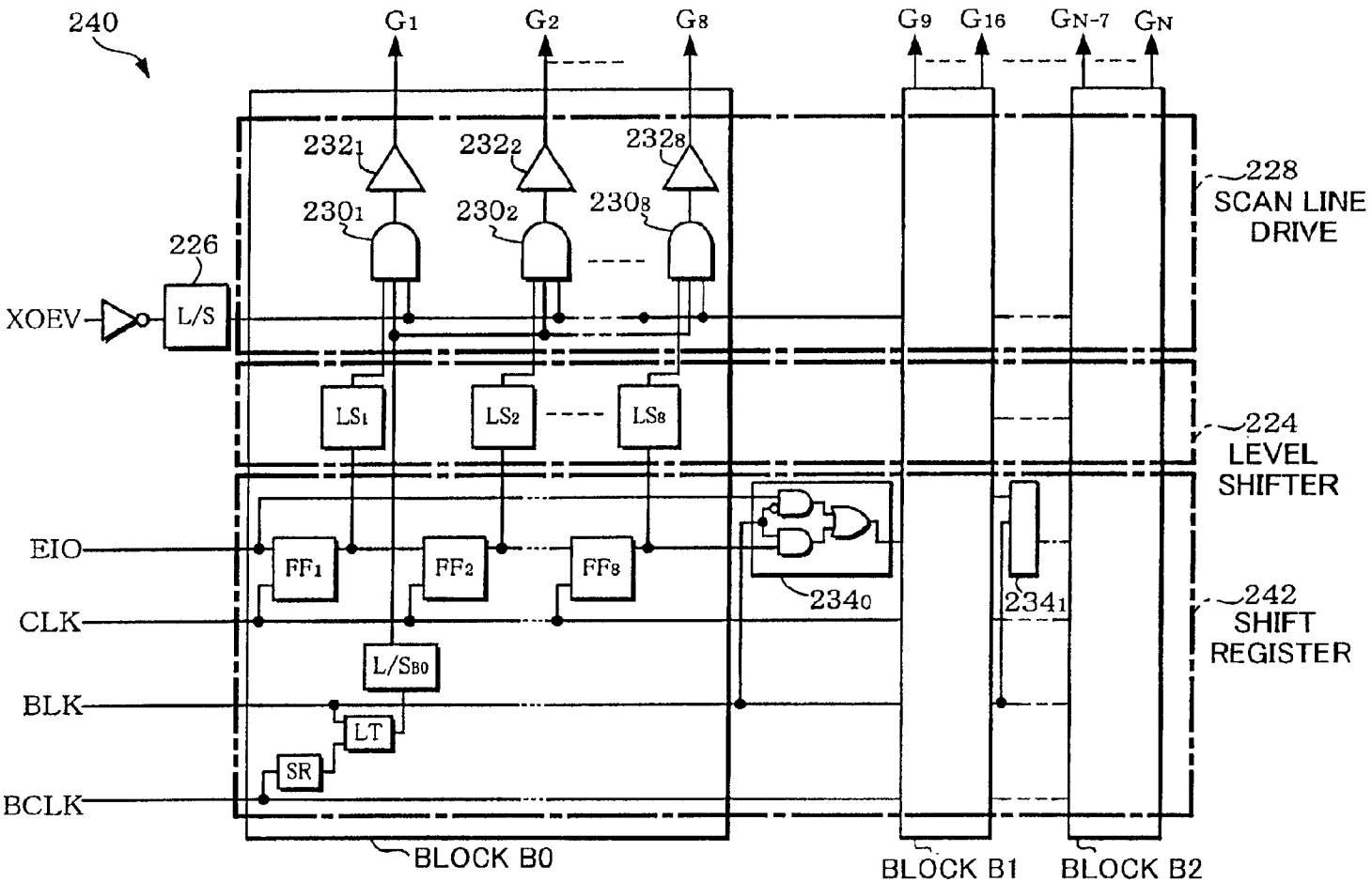
FIG. 17 is a construction diagram showing a construction of a modification of the scan driver in the second construction example.

FIG. 17 shows a construction of a modification of the scan driver in the second construction example.

However, the same portions as those of the scan driver shown in FIG. 16 will be suitably omitted on their description by designating them by the common reference numerals.

A scan driver 240 in this modification is different from the scan driver 220 in the second construction example in that the block select data BLK is latched in a shift register 242 by a latch (LT) in synchronism with the shift output of the clock signal BCLK. By this construction, too, the block select data can be set on a block basis so that the aforementioned effects can be acquired.

Here, the present invention should not be limited to the embodiment thus far described but could be modified in various manners within the scope thereof. For example, the invention should not be limited to the aforementioned drive of the LCD panel but can also be applied to an electro luminescence or plasma display device.

Moreover, the invention has been described on the embodiment, in which the eight adjoining scan lines are divided as one block, but should not be limited thereto. Moreover, no division is required for a plurality of adjoining scan lines, and the scan lines selected at a predetermined scan line interval may be handled as one block.

Still moreover, the scan driver in this embodiment should not be limited to the line inverted drive method but can be applied to the frame inverted drive method.

On the other hand, the embodiment has been constructed such that the display device includes the LCD panel, the scan driver and the signal driver, but should not be limited thereto. For example, the LCD panel may be constructed to include the scan driver and the signal driver.

Still moreover, the embodiment has been described on the active matrix type liquid crystal panel using the TFT liquid crystal, but the invention should not be limited thereto.

What is claimed is:

1. A scan-driving circuit which drives first to Nth (N is a natural number) scan lines of an electro-optical device including a plurality of pixels which are defined by the first to Nth scan lines and first to Mth (M is a natural number) signal lines, the first to Nth scan lines and the first to Mth signal lines crossing each other, comprising:

a shift register which includes first to Nth flip-flops corresponding to the first to Nth scan lines, respectively, and connected in series, and sequentially shifts a given pulse signal;

a level conversion section including first to Nth level shifter circuits which shift the voltage levels of the output nodes of the first to Nth flip-flops and output signals of the shifted voltage levels; and a scan line drive section including first to Nth drive circuits which sequentially drive the first to Nth scan lines corresponding to logic levels of output nodes of the first to Nth level shifter circuits, wherein the first to Nth scan lines are divided into a plurality of blocks, each block constituting a plurality of scan lines, wherein an input terminal which inputs output enable signals synchronized with scanning timings of the scan lines is provided in a block in which the plurality of scan lines are driven, wherein the scan line drive section includes first to Nth mask circuits which mask the logic levels of the output nodes of the first to Nth level shifter circuits based on the output enable signals, and wherein the first to Nth drive circuits drive the plurality of scan lines in a designated block at a time of a partial display in which scan-driving is performed on a block basis.

2. The scan-driving circuit as defined in claim 1, further comprising:

a block select data holding section which holds block select data to designate a block in which the plurality of scan lines are driven, wherein the first to Nth drive circuits drive the plurality of scan lines in the block designated by the block select data.

3. The scan-driving circuit as defined in claim 2, further comprising:

a data switching circuit which bypasses and outputs one of a shift input to be input to a front flip-flop in a Pth (P is a natural number) block of the first to Nth flip-flops which constitute the shift register and a shift output to be output from a last flip-flop in the Pth block, to a (P+1)th block based on the block select data set to select the Pth block.

4. The scan-driving circuit as defined in claim 1, wherein the electro-optical device includes pixel electrodes which correspond to the pixels and are disposed through switching sections connected to the first to Nth scan lines and the first to Mth signal lines, and wherein polarity of applied voltage to electro-optical elements corresponding to the pixel electrodes is reversed in each frame, and wherein the scan line drive section sequentially drives all the scan lines at an interval of given odd number of frames of three or more frames.

5. The scan-driving circuit as defined in claim 1, wherein the electro-optical device includes pixel electrodes which correspond to the pixels and are disposed through switching sections connected to the first to Nth scan lines and the first to Mth signal lines, and wherein the scan line drive section sequentially drives all the scan lines every time designation of the block in which the plurality of scan lines are driven is changed at least on a block basis.

6. The scan-driving circuit as defined in claim 1, wherein the block has eight scan lines.

7. A display device comprising:

an electro-optical device including a plurality of pixels which are defined by first to Nth (N is a natural number) scan lines and a plurality of signal lines, the first to Nth scan lines and the signal lines crossing each other:

a scan-driving circuit which drives the first to Nth scan lines; and a signal drive circuit which drives the signal lines based on image data, wherein the scan-driving circuit includes:

a shift register which includes first to Nth flip-flops corresponding to the first to Nth scan lines, respectively, and connected in series, and sequentially shifts a given pulse signal;

a level conversion section including first to Nth level shifter circuits which shift the voltage levels of the output nodes of the first to Nth flip-flops and output signals of the shifted voltage levels; and a scan line drive section including first to Nth drive circuits which sequentially drive the first to Nth scan lines corresponding to logic levels of output nodes of the first to Nth level shifter circuits, wherein the first to Nth scan lines are divided into a plurality of blocks, each block constituting a plurality of scan lines, wherein an input terminal which inputs output enable signals synchronized with scanning timings of the scan lines is provided in a block in which the plurality of scan lines are driven, wherein the scan drive line section includes first to Nth mask circuits which mask the logic levels of the output nodes of the first to Nth level shifter circuits based on the output enable signals, and wherein the first to Nth drive circuits drive the plurality of scan lines in a designated block at a time of a partial display in which scanning-drive is performed on a block basis.

8. An electro-optical device comprising:

a plurality of pixels defined by first to Nth (N is a natural number) scan lines and a plurality of signal lines, the first to Nth scan lines and the signal lines crossing each other:

a scan-driving circuit which drives the first to Nth scan lines; and a signal drive circuit which drives the signal lines based on image data, wherein the scan-driving circuit includes:

a shift register which includes first to Nth flip-flops corresponding to the first to Nth scan lines, respectively, and connected in series, and sequentially shifts a given pulse signal;

a level conversion section including first to Nth level shifter circuits which shift the voltage levels of the output nodes of the first to Nth flip-flops and output signals of the shifted voltage levels; and a scan line drive section including first to Nth drive circuits which sequentially drive the first to Nth scan lines corresponding to logic levels of output nodes of the first to Nth level shifter circuits, wherein the first to Nth scan lines are divided into a plurality of blocks, each block constituting a plurality of scan lines, wherein an input terminal which inputs output enable signals synchronized with scanning timings of the scan lines is provided in a block in which the plurality of scan lines are driven, wherein the scan drive line section includes first to Nth mask circuits which mask the logic levels of the output nodes of the first to Nth level shifter circuits based on the output enable signals, and wherein the first to Nth drive circuits drive the plurality of scan lines in a designated block at a time of a partial display in which scanning-drive is performed on a block basis.

9. A method of driving a scan-driving circuit which drives first to Nth (N is a natural number) scan lines in an electro-optical device including a plurality of pixels which are defined by the first to Nth scan lines and first to Mth (M is a natural number) signal lines, the first to Nth scan lines and the first to Mth signal lines crossing each other, based on logic levels of output nodes of first to Nth level shifter circuits, the method comprising:

setting a mode to a partial display mode for partially displaying an area on a block basis, in which the first to Nth scan lines are divided into a plurality of blocks, each block constituting a plurality of scan lines;

inputting output enable signals synchronized with scanning timings of the scan lines provided in a block in which the plurality of scan lines are driven, the output enable signals being at different logic levels corresponding to display and non-display; and driving the plurality of scan lines sequentially in a designated block at the time of the partial display mode.

10. The method as defined in claim 9, further comprising:

driving all the scan lines sequentially for every predetermined frames at the time of the partial display mode.

11. The method as defined in claim 10, wherein polarity of applied voltage to the pixels is reversed in each frame, and wherein all the scan lines are sequentially driven at an interval of odd frames of three or more frames.

12. The method as defined in claim 9, wherein all the scan lines are sequentially driven every time designation of the block to be set for partial display is changed.

13. The method as defined in claim 9, wherein, after driving of the plurality of scan lines in the designated block has ended in one frame, driving of all the scan lines is interrupted for the residual period of the frame.

* * * * *